US010900222B2

(12) United States Patent
Smith

(10) Patent No.: US 10,900,222 B2
(45) Date of Patent: Jan. 26, 2021

(54) SPECIAL LIGHTWEIGHT, DURABLE MOUNTING SYSTEM FOR SOUND FOAM PANEL AND QUICK INSTALLATION PROCESS

(71) Applicant: Kyler Smith, Mooresville, IN (US)

(72) Inventor: Kyler Smith, Mooresville, IN (US)

( * ) Notice: Subject to any disclaimer, the term of this patent is extended or adjusted under 35 U.S.C. 154(b) by 0 days.

(21) Appl. No.: 16/278,144

(22) Filed: Feb. 17, 2019

(65) Prior Publication Data

US 2019/0257079 A1 Aug. 22, 2019

Related U.S. Application Data

(60) Provisional application No. 62/631,758, filed on Feb. 17, 2018.

(51) Int. Cl.
*E04B 1/86* (2006.01)
*E04B 1/82* (2006.01)
(Continued)

(52) U.S. Cl.
CPC ..... *E04B 1/86* (2013.01); *E04B 2001/742* (2013.01); *E04B 2001/8263* (2013.01); *E04B 2001/8419* (2013.01); *E04B 2001/8428* (2013.01)

(58) Field of Classification Search
CPC ..... E04F 15/20; E04F 15/206; E04B 1/86; E04B 1/99; E04B 1/82; E04B 2001/8263;
(Continued)

(56) References Cited

U.S. PATENT DOCUMENTS 1,703,011 A * 2/1929 Mazer ..... E04B 1/86 181/287
1,721,461 A * 7/1929 Mazer ..... E04B 1/8409 181/290
(Continued)

FOREIGN PATENT DOCUMENTS

EP 0816583 A1 * 1/1998 ..... E04B 1/8409
FR 938147 A * 9/1948 ..... E04B 1/99

OTHER PUBLICATIONS

Machine translation for foreign reference EP 0816583 A1, obtained from https://patentscope.wipo.int/search/en/detail.jsf?docId=EP12947384&tab=PCTDESCRIPTION&_cid=P12-K3T867-54516-1#atapta0 (last accessed on Dec. 5, 2019) (Year: 2019).*
(Continued)

*Primary Examiner* — Theodore V Adamos
(74) *Attorney, Agent, or Firm* — Ritchison Law Offices, PC; John D Ritchison

(57) ABSTRACT

A lightweight, durable mounting system for sound foam panels that provides a quick installation process and that solves the basic question of how a musician, home owner, renter, tenant, or person looking to make a room quieter can install sound absorbing foam panels in a fast, cheap, and un-harmful manner. The system includes an acoustical pad with selected sound absorption capabilities with an optional firm backing attached to the pad, an optional firm lay-in sheet with or without adhesive, a containment frame a fastening manner for removably securing the acoustical pad to the frame, and an installation way such as rings for hanging or adhesive pads for surface mounting to walls or ceilings.

20 Claims, 19 Drawing Sheets

Figure 1B:
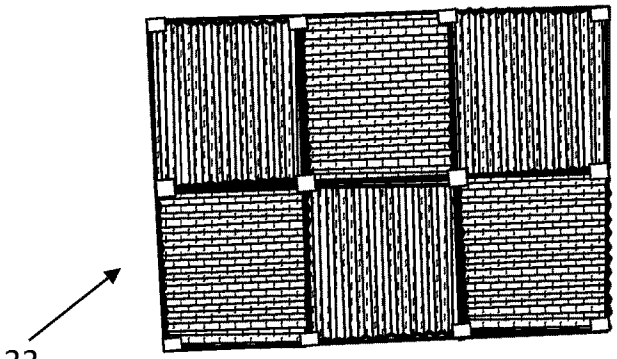
Figure 1E:
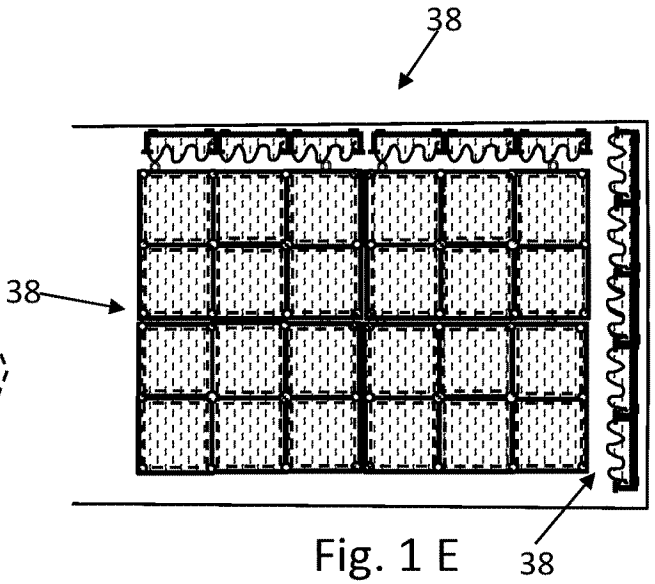
Figure 1D:
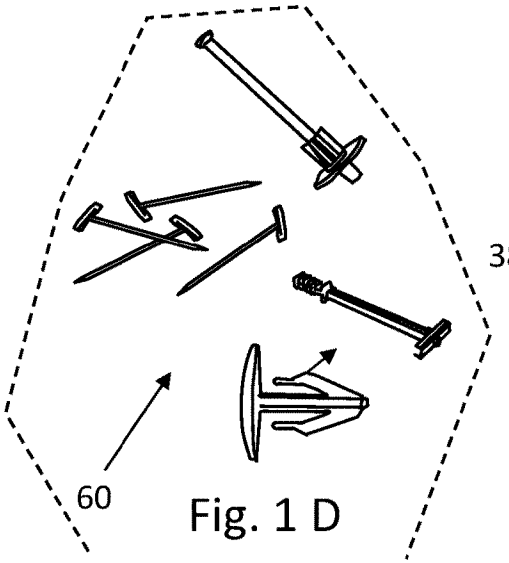
Figure 1A:
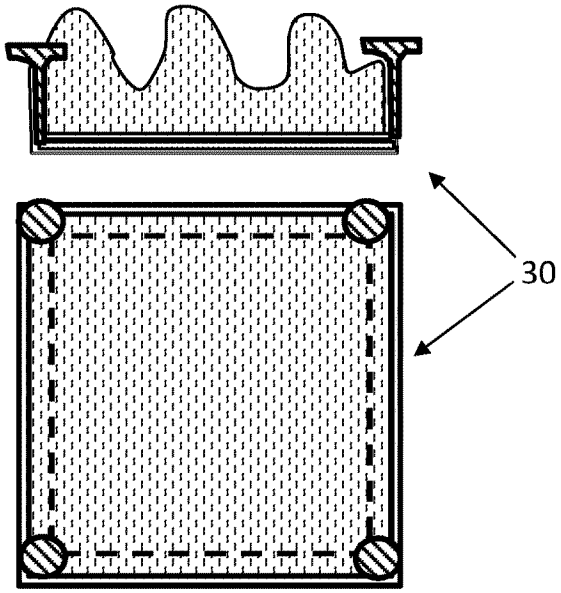
Figure 1C:
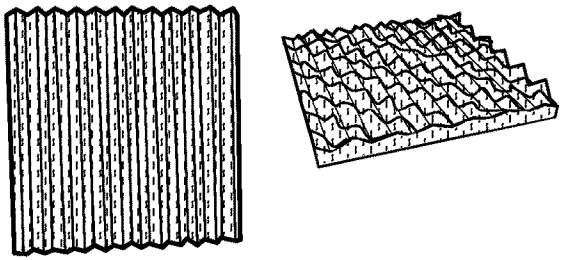

(51) Int. Cl.
*E04B 1/74* (2006.01)
*E04B 1/84* (2006.01)

(58) Field of Classification Search
CPC ..... E04B 1/8209; E04B 1/8227; E04B 2001/8281; E04B 1/8409; E04B 2001/8423; E04B 2001/8442; E04B 2001/8476; E04B 2001/8414; E04B 2001/8419; E04B 2001/8457; E04B 2001/746; E04B 2001/8428
See application file for complete search history.

(56) References Cited

U.S. PATENT DOCUMENTS 2,169,370 A * 8/1939 Parkinson ..... E04B 1/86 181/291
4,702,046 A * 10/1987 Haugen ..... E04B 1/10 181/286
5,009,043 A * 4/1991 Kurrasch ..... E04B 1/8227 181/290
5,334,806 A * 8/1994 Avery ..... E04B 1/90 181/286
8,418,807 B1 * 4/2013 Nevins ..... E04B 1/8227 181/210
8,960,367 B1 * 2/2015 Leclerc ..... G10K 11/20 181/286
2014/0093670 A1 * 4/2014 Lucchese ..... E04B 1/767 428/58
2014/0262603 A1 * 9/2014 Johnson ..... E04B 1/86 181/211
2017/0138041 A1 * 5/2017 Cullen ..... E04B 1/86
2018/0328036 A1 * 11/2018 Kolcun ..... E04C 2/292

OTHER PUBLICATIONS

Machine translation of foreign reference FR938147A, obtained from https://translationportal.epo.org/emtp/translate/?ACTION=description-retrieval&COUNTRY=FR&ENGINE=google&FORMAT=docdb&KIND=A&LOCALE=en EP&NUMBER=938147&SRCLANG=fr&TRGLANG=en (last accessed on Oct. 8, 2020) (Year: 2020).*

* cited by examiner

Wedge Foam Acoustic Panels

Pyramid Foam Acoustic Panels

Mainstays Foam Mattress Pad

Sound-Proof Rug Pads

Studio monitor speaker pads

Acoustic Foam XL Bass Trap
Studio Soundproofing Corner Wall

Eggshell foam panels

Multicolor foam panels

Super-dense soundproofing

High dollar sound panels

Cork Panels

Foam Panels with bevel

Grid Panels

Hooks

L shape screws

L clips

Right angle Brackets

Rivets and car rivets

Pin washers

Toggle bolts

T-pins

Mic clips

Aluminum and metal channels

Framing angles

Metal hanger straps

Plastic hanger strap

Wire Cable clips

Light bulb clips

Plywood Clips

Decking ties

T straps

Double Clips

Header hangers

U clips

Lock pins

Wire of any sorts

Drywall clips

Wall ties

Purlin anchors

Shower and glass clips

Square brackets

Zip ties

Nylon straps

Tee structure

L structure

Channel structure

Top/ angle

Zoomed out

Sidewalls

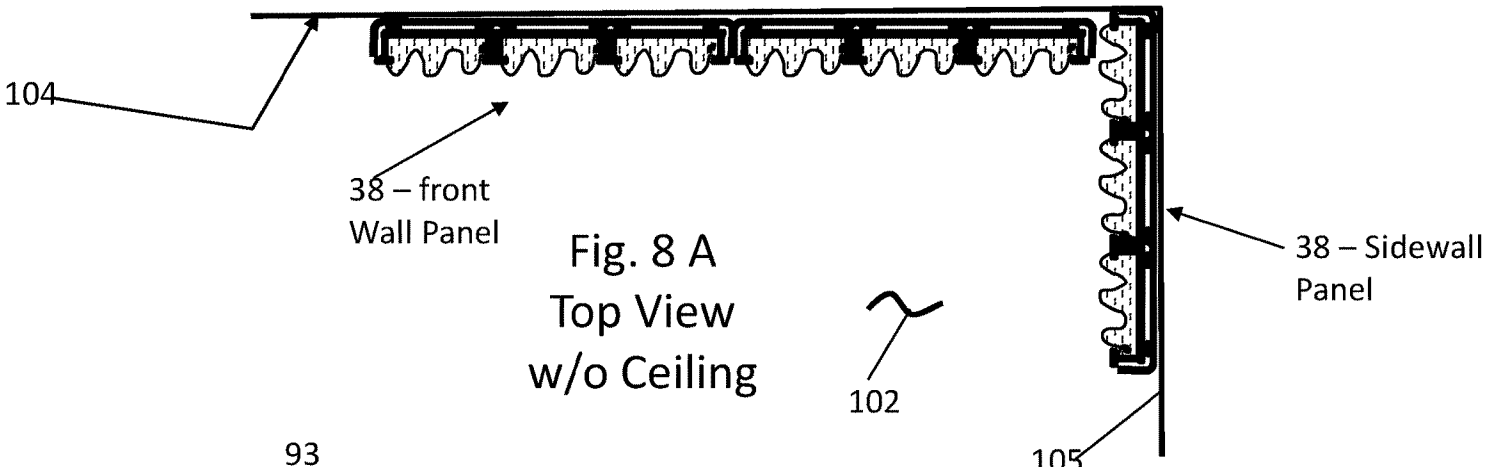
Fig. 8 A
Top View
w/o Ceiling
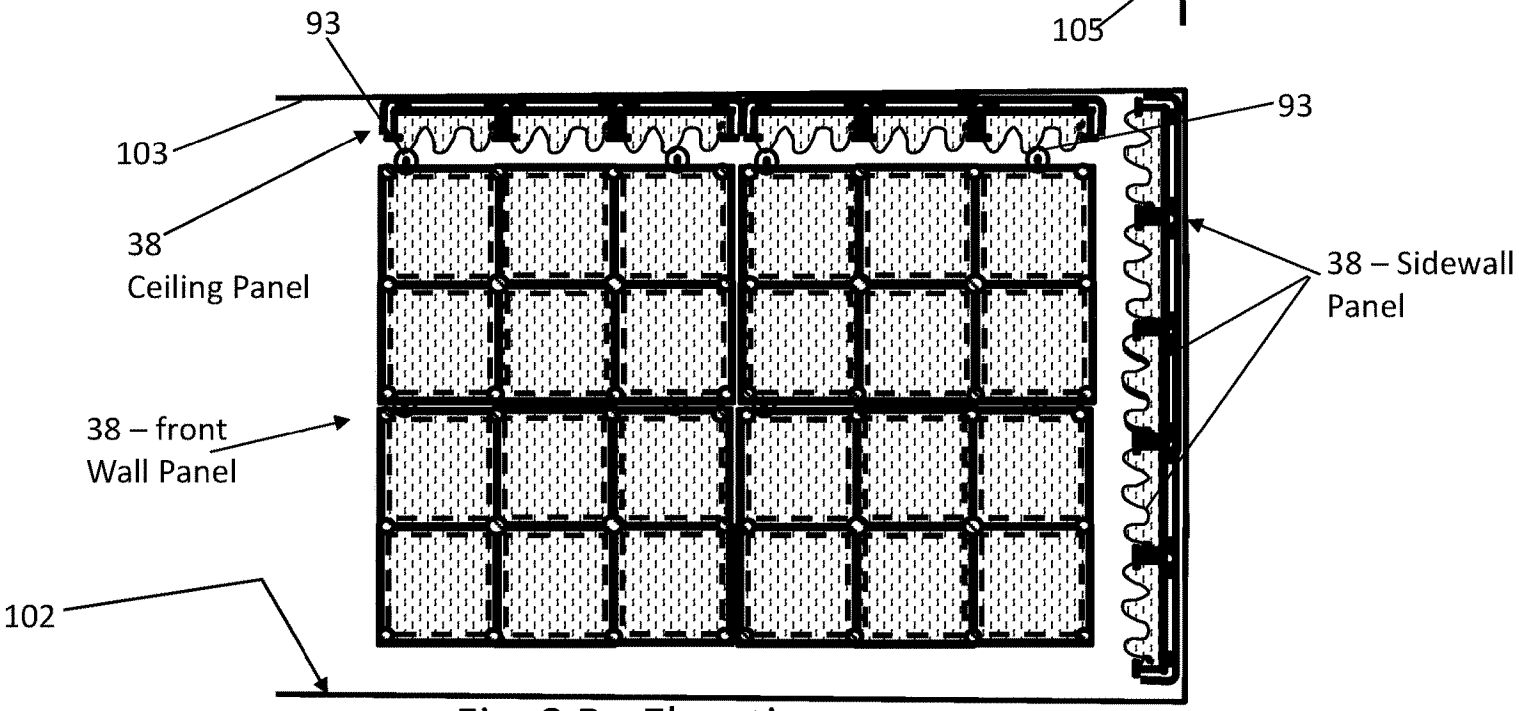
Fig. 8 B - Elevation

Ceiling - Hanged

Floor Layout
Mounting Frames Omitted

Ceiling

US Pat. 5,069,011
Prior Art

US 2012/0152468
US Pat 8,091,605
Prior Art

US Pat 5,009,043
Prior Art

US 9,378,726 Prior Art

US Pat 9,163,398 Prior Art

US 2008/0029336
Prior Art

SPECIAL LIGHTWEIGHT, DURABLE MOUNTING SYSTEM FOR SOUND FOAM PANEL AND QUICK INSTALLATION PROCESS

CROSS-REFERENCE TO RELATED APPLICATIONS

This application claims the benefit of United States Provisional patent application with Ser. No. 62/631,758 filed Feb. 17, 2018 by Kyler Smith as sole inventor. The application was entitled "Special lightweight, durable mounting system for sound foam panel and quick installation process".

FIELD OF INVENTION

This invention relates to a Special lightweight, durable mounting system for sound foam panel and quick installation process. The present invention relates generally to acoustic panels. More particularly, the present invention relates to an acoustic panel having an easy to install and a portable capability. This invention also relates to components and more particularly to temporary components adapted to attenuate the transmission of noise.

This invention and application relate to the field of acoustic panels. This application relates to systems, structures, materials and designs used as sound and noise barriers. This relates to portable acoustical panels used in small or large performances to reflect and enhance the sound produced during rehearsals or recordings and such. The devices usually are assembled by placing a plurality of panels in adjacent relationship so as to form a screen or shell. The panels are ordinarily portable and packaged for storage or to selectively vary the shell configuration when the panels are disposed in operative position. Each panel usually has a framework which may be disposed vertically, horizontally, or at a selected angle to the vertical, often facing forwardly toward the audience or performer, to focus the acoustical reflection in the desired direction.

FEDERALLY SPONSORED RESEARCH

None.

SEQUENCE LISTING OR PROGRAM

None.

BACKGROUND

Field of Invention and Prior Art

A novelty search revealed that, as far as known, there are no Special lightweight, durable mounting system for sound foam panel and quick installation process or the like. It is believed that this product is unique in its design and technologies. One also notes that this section introduces aspects that may help facilitate a better understanding of the disclosure. Accordingly, these statements are to be read in this light and are not to be understood as admissions about what is or is not prior art.

Technicalities of Noise and Sound

Acoustic absorbing materials have been used in many fields. In workplace environments, acoustic panels have been provided to control the sound level therein. In the past, acoustic panels have been formed using a perimeter frame, an acoustic absorbing material within the frame and an outer skin. The outer skin was designed to be acoustically transparent or partially acoustically transparent. Acoustic energy could then pass through the covering and be absorbed by the acoustic absorbing material within the interior of the acoustic panel.

A major component of noise generated by household appliances, road traffic or industrial noise occurs in the frequency band of 20-4000 Hz. Noting that the human audible frequency range is 20 Hz to 20 kHz, this band is at the lower end of the audible frequency range. For purposes of this disclosure, low frequency band is defined to be ranging from 20 Hz to 4000 Hz. One notes that Methods to control noise can be broadly grouped into (a) reducing the noise generated at source, (b) passive noise control, and (c) active noise control. Focusing on the passive control methods, the solutions are mainly based on two mechanisms, (1) reflection and (2) absorption. The solutions based on the reflection mechanism are referred to as sound barrier materials and those based on absorption are called sound absorbing materials. The performance of conventional sound barrier materials is in general governed by their inertia in the low frequency range, stiffness in the high frequency range, and by damping in the intermediate range defined by its characteristic coincidence frequency. The performance of the conventional barrier material in the inertia controlled region becomes poorer as the frequency is reduced. Considering the sound absorbing materials, conventionally, porous materials are used to absorb the energy of the incident sound by dissipation into heat through the back and forth motion of the fluid carrying the sound wave in the pores. The challenge here is that these materials require large space to enable sizable energy absorption, particularly in the low frequency range. For a sound wave at low frequencies, the wavelength is of the order of meters, and therefore the absorbing material needs large space which is again undesirable. Therefore a portable, small control system is desirable.

The present invention is generally a portable and acoustical partition designed to isolate unwanted sound and ensure the most advantageous flow of properly diffused sound. More particularly, the invention relates to an acoustical partition for a stereo listening or recording room in the home and office which functions to balance the frequencies from the sound output by absorbing standing base wavelengths and providing multi-wavelength absorption and reflection capabilities for mid-wavelengths and high-wavelengths. In open space, the energy from an emanating sound proceeds outward. However, in an enclosure, such as a room, the distribution of sound emanating from a source is altered by confining the energy to the boundaries of the enclosure. For example, the sound pressure at a given distance from a sound source in an enclosure will no longer be constant with frequency, as in the open air, but instead will be much higher at the resonant frequencies of the enclosure. The sound in a room is perfectly diffuse if its pressure is the same throughout the room and if it is equally probable that waves are travelling in every direction at all points within the room. Such complete diffusion is not only undesirable, but impossible to obtain. Both objects within a room, and the geometry and structure of the walls of the room, increase the diffusion of sound in the room by scattering and consequently randomizing the directions of the sound waves. Further, when sound waves strike a surface, part of the incident energy is absorbed. The materials used in constructing the walls of a room and the objects contained in the room will absorb some sound. Sound is absorbed by any mechanism which converts incident sound waves into another form of energy, namely heat.

Acoustic absorption will depend on the porosity of the material. The sound waves from the sound source are converted into heat by moving through the interstitial spaces of the material and by the vibration of the small fibers of the material. Sound absorption also occurs when sound waves force a panel to vibrate. The vibration converts a fraction of the incident sound energy into heat.

Transmission loss (TL) relates to the noise-insulating value of partitions, windows, and doors. TL is the unit amount measured in decibels that the incident sound energy is reduced as a result of being transmitted through a partition. The TL amount does not take into effect sound reflected or transferred from room to room. Higher numbers of decibel loss indicate a better noise-insulating partition. Sound Transmission Class (STC) is a universal standard to describe the sound isolation abilities of all types of partitions. However, STC values are designed to correlate with sound isolation from normal sounds found in residences and offices. Therefore, they are not easily applied to a high performance partition or wall which needs to cover a broad musical spectrum such as that contemplated by the present invention. A preferred method for evaluating such a high performance partition is to analyze the transmission loss/frequency spectrum.

Problems Solved

This solves how a musician, home owner, renter, tenant, or anyone looking to make a room quieter can hang foam panels fast, cheap, and without harmful effects to the walls or foam panels.

There is a need in the art for a simplified lightweight easily transportable acoustical panel construction which may be oriented in different configurations and which does not employ heavy and dangerous panel fastening and adjustment brackets. For ease of operation and storage, the acoustical panel structure should be easily foldable and/or transportable by a single individual and a plurality of panel structures should be easily placed closely together for storage.

The design of lightweight passive treatments for noise control applications in the low frequency range has been a challenge due to the needed high mass per unit area. Thereby, blocking of low frequency sound has conventionally only been achieved by using relatively high masses, since alternative stiffness-based or dissipation-based solutions are usually ineffective in that frequency range for unsupported, homogeneous panels. However, no acoustic partition currently exists which provides both adequate mass for maximum absorption at the low frequency range and equal surface absorption for reflective wavelengths at the mid-frequency and high-frequency range. Accordingly, there is an unmet need for noise control solutions that address the challenges of designing lightweight barriers, particularly in low frequency ranges.

PRIOR ART

A novelty search reviewed several attempts by earlier inventors to address these problems. However, none have anticipated nor deemed obvious the Special lightweight, durable mounting system for sound foam panel and quick installation process. The search revealed:

A. U.S. Pat. No. 5,009,043 by Kurrasch issued in 1991 is entitled Acoustic Panel. It shows an acoustic panel having highly desirable sound absorption characteristics. The panel is stated to be preferably formed of an open frame with there being at least one septum centrally located within the frame opening and in contact with the frame members. On each side of the septum are expanded fiberglass batts. Both sides of the frame are faced with perforated hardboard sheets which, in turn, are covered by an open-cell foam layer and a layer of scrim material comprising metal foil and a tear-resistant backing. The panels can be covered with a decorative fascia such as fabric or synthetic sheet materials.

B. U.S. Pat. No. 5,069,011 by Jenne issued in 1991 was called a Portable acoustical panel structure. It teaches a lightweight portable acoustical panel for stage or theatrical use which can be oriented in either an upright position or in a sideways position is provided with a weighted supporting base having a roller thereon which is disposed at one corner only of the panel structure whereby the structure can be easily moved about.

C. U.S. Pat. No. 8,087,494 by Palumbo et al. issued in 2012 is named a Method of making a composite panel having subsonic transverse wave speed characteristics. Taught here is a method of making a composite panel having subsonic transverse wave speed characteristics which has first and second sheets sandwiching a core with at least one of the sheets being attached to the core at first regions thereof and unattached to the core at second regions thereof.

D. U.S. Pat. No. 8,091,605 by Melhart issued in 2012 is entitled an Acoustic panel assembly. Provided by this invention is an acoustic panel assembly may have one or more panels adaptable for reflecting sound waves and a support member to which the one or more panels may be attached. The support member may be extendable and retractable. The one or more panels and the support member can be collapsible into a housing. The one or more panels may be configured in one or more substantially planar portions, one or more substantially curved portions, or a combination thereof.

E. U.S. Pat. No. 8,978,816 by Slotznick issued in 2015 is named a Sound limiting acoustic shell using a hanging acoustic canopy. It demonstrates a temporary building structure is provided. The temporary building structure includes a top wall and an opposing floor surface covered by the top wall. The top wall and the floor surface define a first building area and a second building area. The first building area includes a floor surface configured to receive a sound source. The structure further includes a portable sound limiting acoustic shell including an acoustic canopy covering at least a portion of the first building area in which the sound source is positioned. The acoustic canopy is positioned proximate the floor surface, such that the acoustic canopy concentrates sound generated by the sound source within the first building area and isolates the generated sound from the second building area.

F. A U.S. patent application was published as No. 2004/0237464 by Khan in 2004. It is called a Noise attenuator. Here I provided a noise attenuating member that has a channel for receiving a timber batten. A flooring may be affixed to the batten. The noise attenuating member acts as a cushion between the batten and a substrate such as a joist or a concrete slab. Noise attenuating holes and retaining flanges may optionally be provided.

G. A U.S. patent application was published as No. 2008/0029336 by Sigler et al. in 2008. It is called an Acoustic panel. Taught in this application is an acoustic panel is provided. The acoustic panel includes a frame, an acoustic absorbing material, and an outer skin. The frame has a plurality of apertures there along and an interior space. An acoustic absorbing material is located within the interior space. The outer skin covers the front surface of the frame.

H. Another U.S. patent application was published as No. 2012/0152468 by Melhart in 2012 and is entitled an Acoustic Panel Assembly. Shown here is an acoustic panel assembly that may have one or more panels adaptable for reflecting sound waves and a support member to which the one or more panels may be attached. The support member may be extendable and retractable. The one or more panels and the support member may be collapsible into a housing. The one or more panels may be configured in one or more substantially planar portions, one or more substantially curved portions, or a combination thereof.

I. A U.S. patent application was published as No. 2015/0090526 by Sasaki in 2015 called a Sound Absorbing (Acoustic) Board. This is a sound absorbing board that is a sound absorbing board where a decorative layer and a rigid substrate material are laminated, and where the substrate material contains parallel grooves spaced at a pre-determined distance, and also, where the cross sectional surface of the grooves in a direction perpendicular to the longitudinal direction of the substrate has a shape that contains mutually adjacent neck parts and trunk parts is described. The sound absorbing board has decorative properties and at the same time has sound absorbing, sound isolation properties, and can be easily processed.

J. Finally, a U.S. Pat. No. 1,554,180 by S. W. Trader issued in 1925 was named a SOUND-ABSORBING BOARD FOR WALLS AND CEILINGS. This patent teaches and relates to sound absorbing boards or material, and has for its object to provide an article of manufacture that will be simple in construction and for the same absorbing capacity will be less costly to make than those heretofore proposed.

In the prior art, the acoustic shell encloses portions of the performance area with a back wall, side walls, and a canopy (above the performance area). Such an acoustic shell acts in some ways like a megaphone or bull horn, with sound produced at the narrow end of the megaphone (the rear of the acoustic shell) and emitted towards the audience at the wider of the megaphone (the wider front of the shell). The most efficacious acoustic shells enclose all sides and top of the performance area, but portability concerns have often required some compromises in coverage.

As can be observed, none of the prior art has anticipated or caused one skilled in the art permanent or temporary acoustical and noise attenuating panels to see this new invention by Kyler Smith as obvious—to a person skilled in the ordinary art of this industry. The new invention provides advantages and benefits as described in the later paragraphs herein.

SUMMARY OF THE INVENTION

This invention is a Special lightweight, durable mounting system for sound foam panel and quick installation process. It solves the basic question: "How can a musician, home owner, renter, tenant, or anyone looking to make a room quieter hang foam panels fast, cheap, and without harmful effects to the walls or foam panels?" The preferred embodiment of the invention a Special lightweight, durable sound foam panel device and system with a quick installation process, the device is comprised of: (a) an acoustical pad with selected sound absorption capabilities with and optional firm backing attached to the pad; (b) an optional firm lay-in sheet with or without adhesive; (c) a containment frame; (d) a fastening means for removably securing the acoustical pad to the frame; and (e) an installation means such as rings for hanging or adhesive pads for fastening to surfaces such as walls or ceilings wherein the sound foam panel device and system provides a lightweight and portable acoustical panel structure which is easily installed and used for sound attenuation and recording studios.

The newly invented Special lightweight, durable mounting system for sound foam panel and quick installation process can be manufactured at low volumes by very simple means and in high volume production by more complex and controlled systems.

Objects and Advantages

There are several objects and advantages of the Special lightweight, durable mounting system for sound foam panel and quick installation process. There are currently no known devices that are effective at providing the objects of this invention. It has various advantages and benefits:

| Item | Advantages |
|---|---|
| 1 | Is lightweight |
| 2 | Is durable |
| 3 | Is unlike anything on the market today |
| 4 | Can hold up to 32 1' × 1' foam sound panels |
| 5 | Has no assembly required |
| 6 | Is offered in different sizes and depths |
| 7 | Has multiple bracket options for cosmetic reasons |
| 8 | Is fashionable and cool to look at and has good aesthetics |
| 9 | Mounts with less and even no holes in the wall compared to what is current industry foam and acoustical standard |
| 10 | Is portable and easy to put up in less than 5 minutes |
| 11 | Can connect to other mounts for different room layouts |
| 12 | Can use single panel holders for portable mic set ups - better and cheaper than current solutions |
| 13 | Can be used anywhere and in any situation |
| 14 | Has potential to make improvements and create other applications for it |
| 15 | Is inexpensive to manufacture and buy |
| 16 | Is a perfect solution for start-up studios and musicians |
| 17 | Has fewer parts than anything in its category |
| 18 | Is easier to make than anything in its category |
| 19 | Is not age specific, can be used in children's rooms, doctor's offices, studios, houses, rental properties, apartments, dorms, busses, cars |

Finally, other advantages and additional features of the present lightweight, durable sound foam panel mounting device will be more apparent from the accompanying drawings and from the full description of the device. For one skilled in the art of mounting sound control and panel devices and systems it is readily understood that the features shown in the examples with this product are readily adapted to other types of mounting for portable sound panel systems and devices.

DESCRIPTION OF THE DRAWINGS—FIGURES

The accompanying drawings, which are incorporated in and constitute a part of this specification, illustrate an embodiment of the Special lightweight, durable mounting system for sound foam panel and quick installation process that is preferred. The drawings together with the summary description given above and a detailed description given below serve to explain the principles of the mounting for a portable sound panel device and system. It is understood, however, that the device and system presented is not limited to only the precise arrangements and instrumentalities shown.

FIGS. 1 A through 1 E are sketches of Special lightweight, durable mounting system for sound foam panel and quick installation process, its components and installation.

Figure 2:
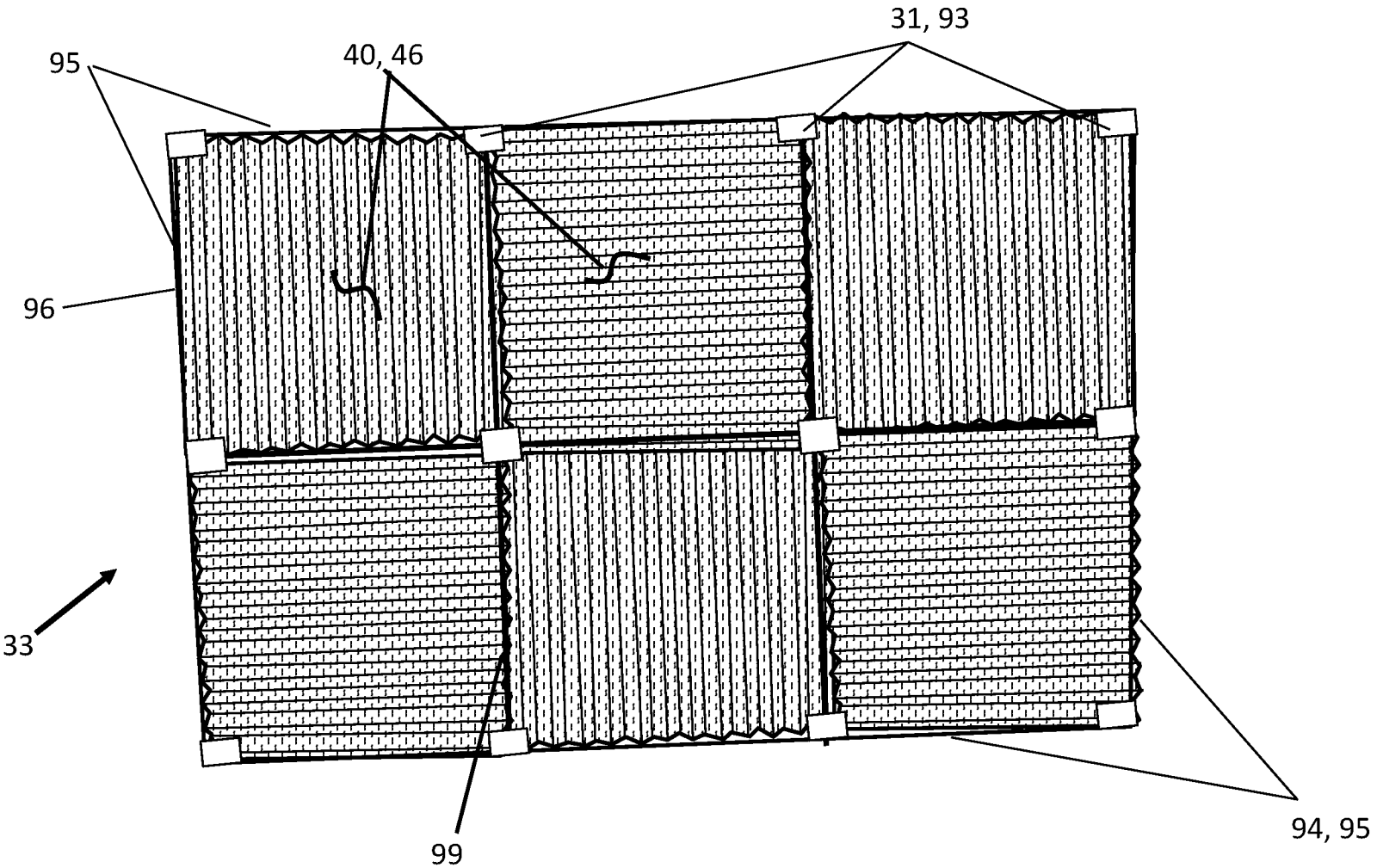

FIG. 2 is a prototype of the Special lightweight, durable mounting system for sound foam panel with components and features noted.

Figures 3A, 3B, 3C, 3D:
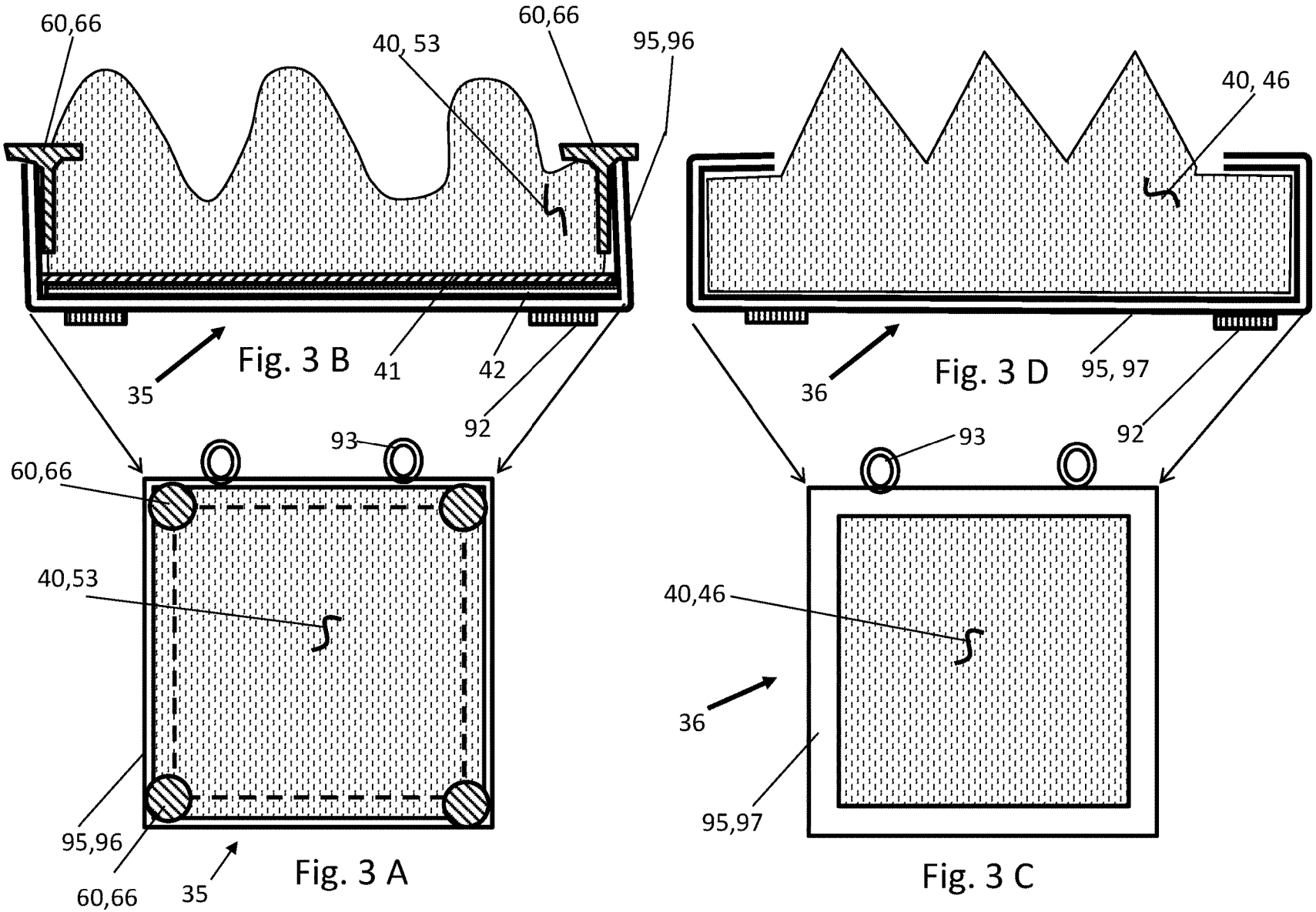
Figure 4A:
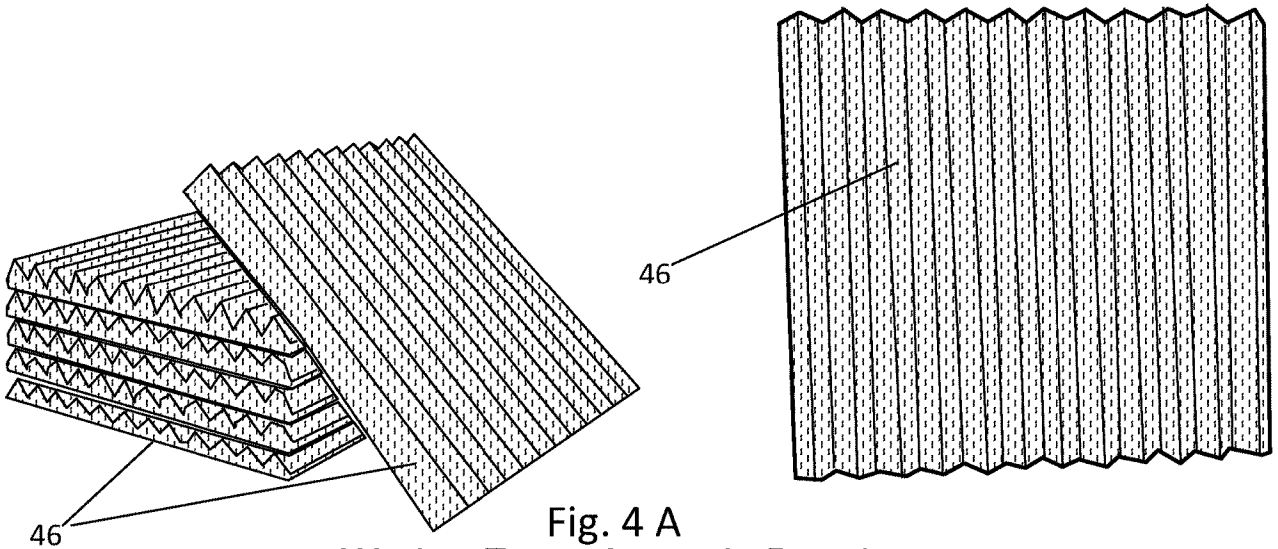
Figure 4C:
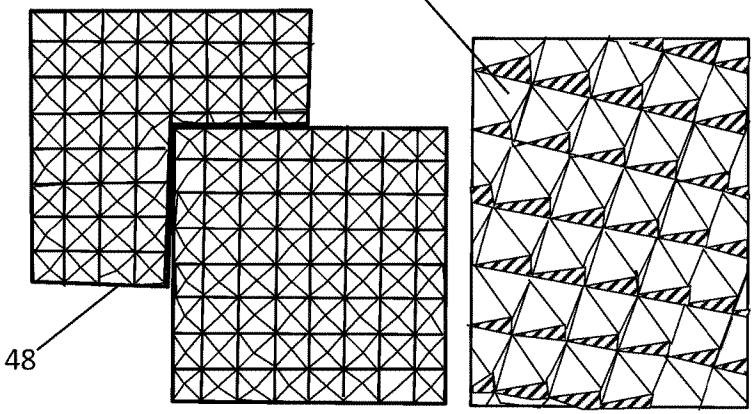
Figure 4B:
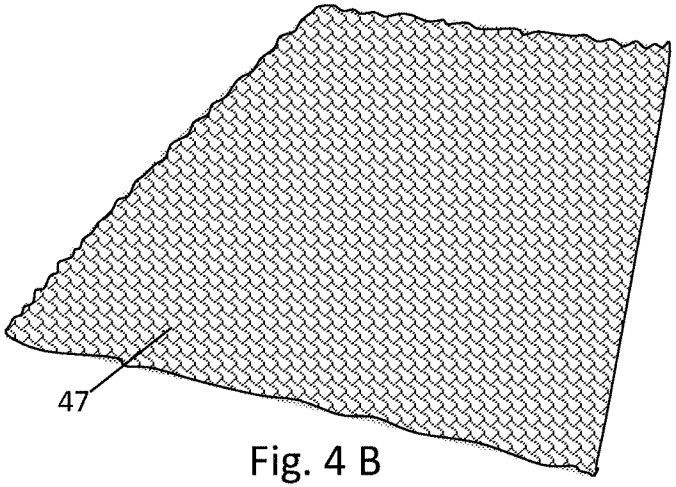
Figure 4D:
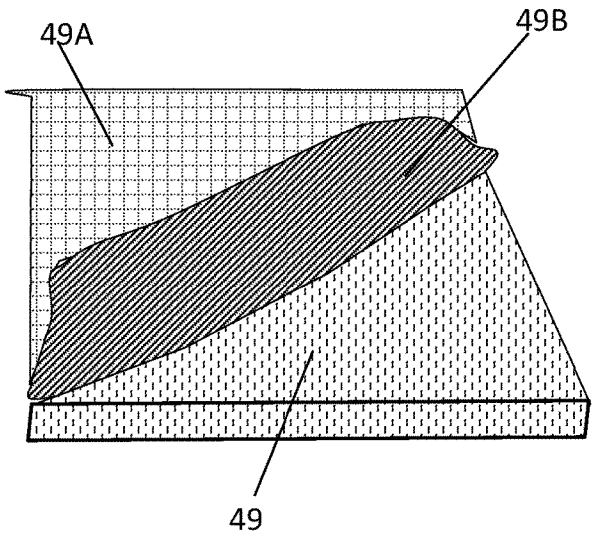
Figure 4D:
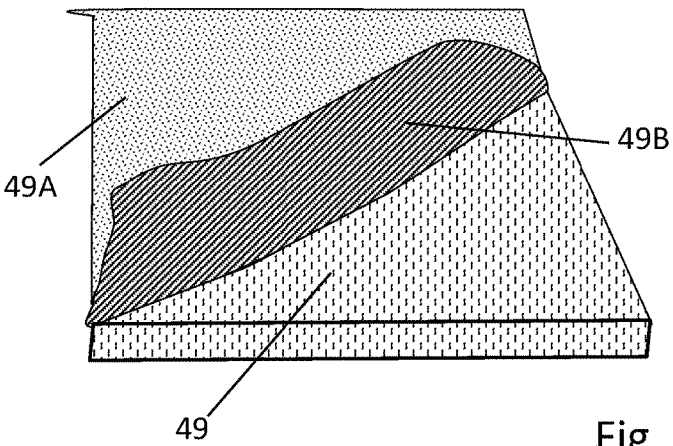
Figure 4F:
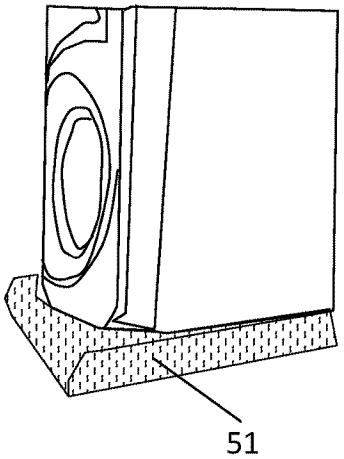
Figure 4F:
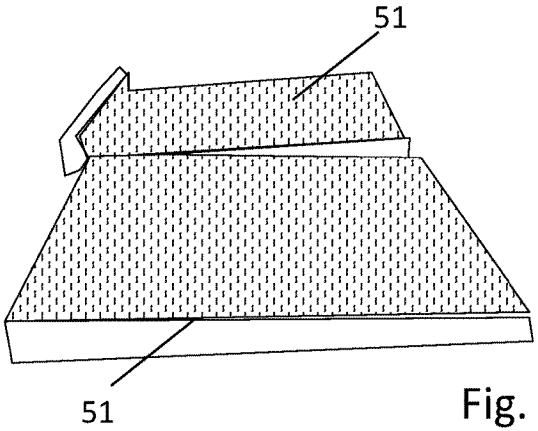
Figure 4E:
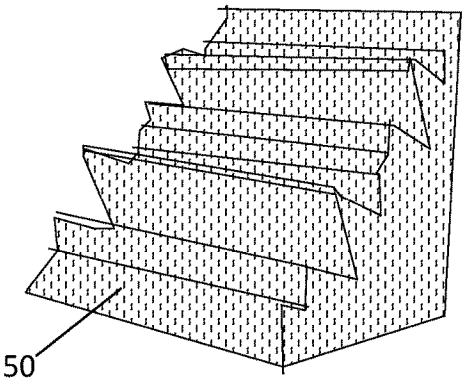
Figure 4H:
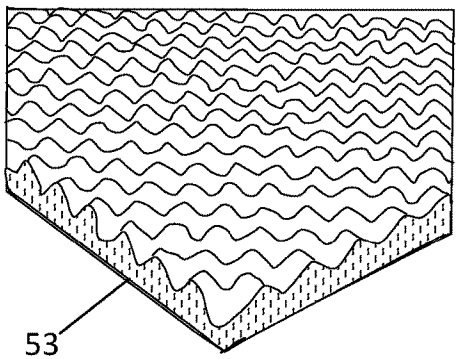
Figure 4J:
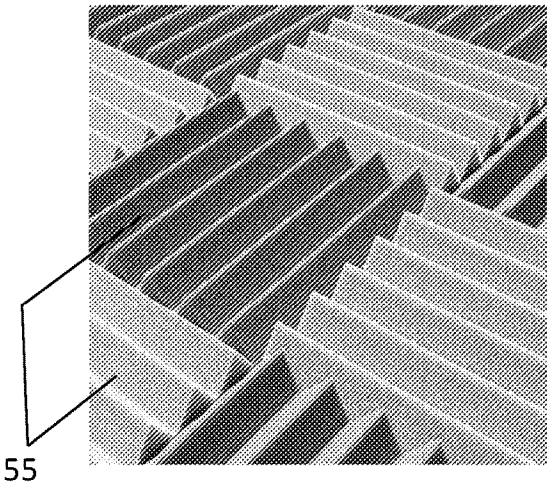
Figure 4G:
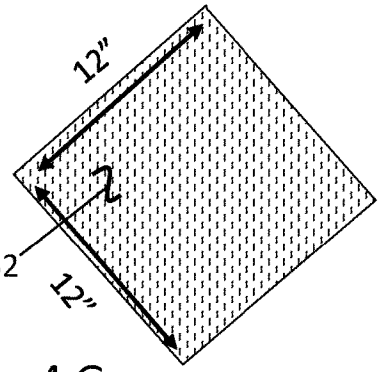
Figure 4G:
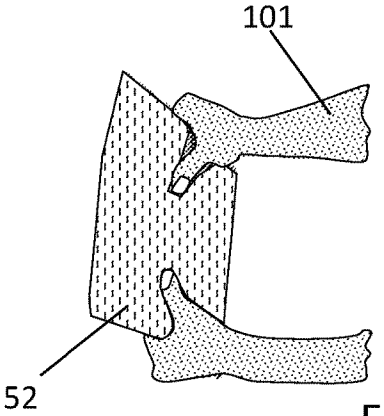
Figure 4I:
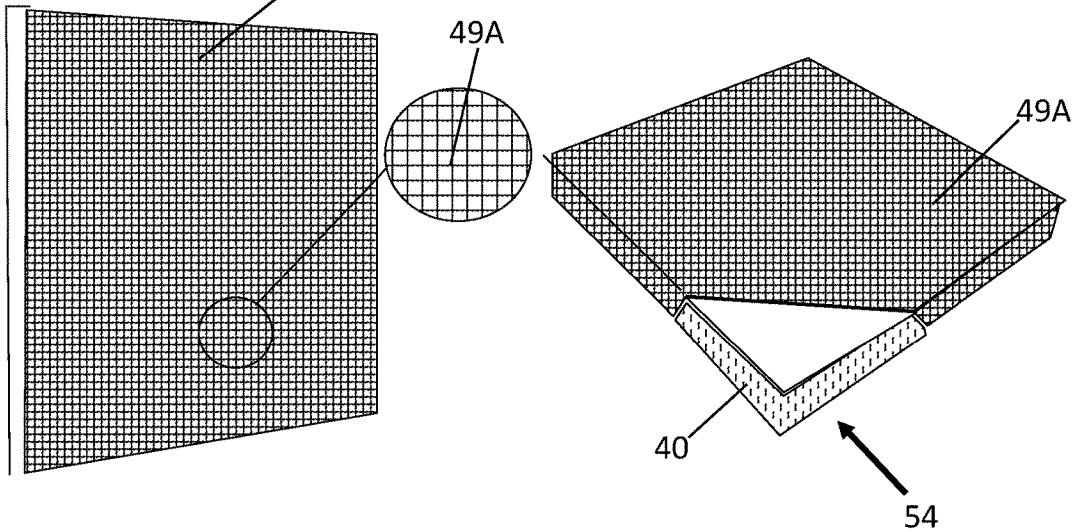
Figure 4L:
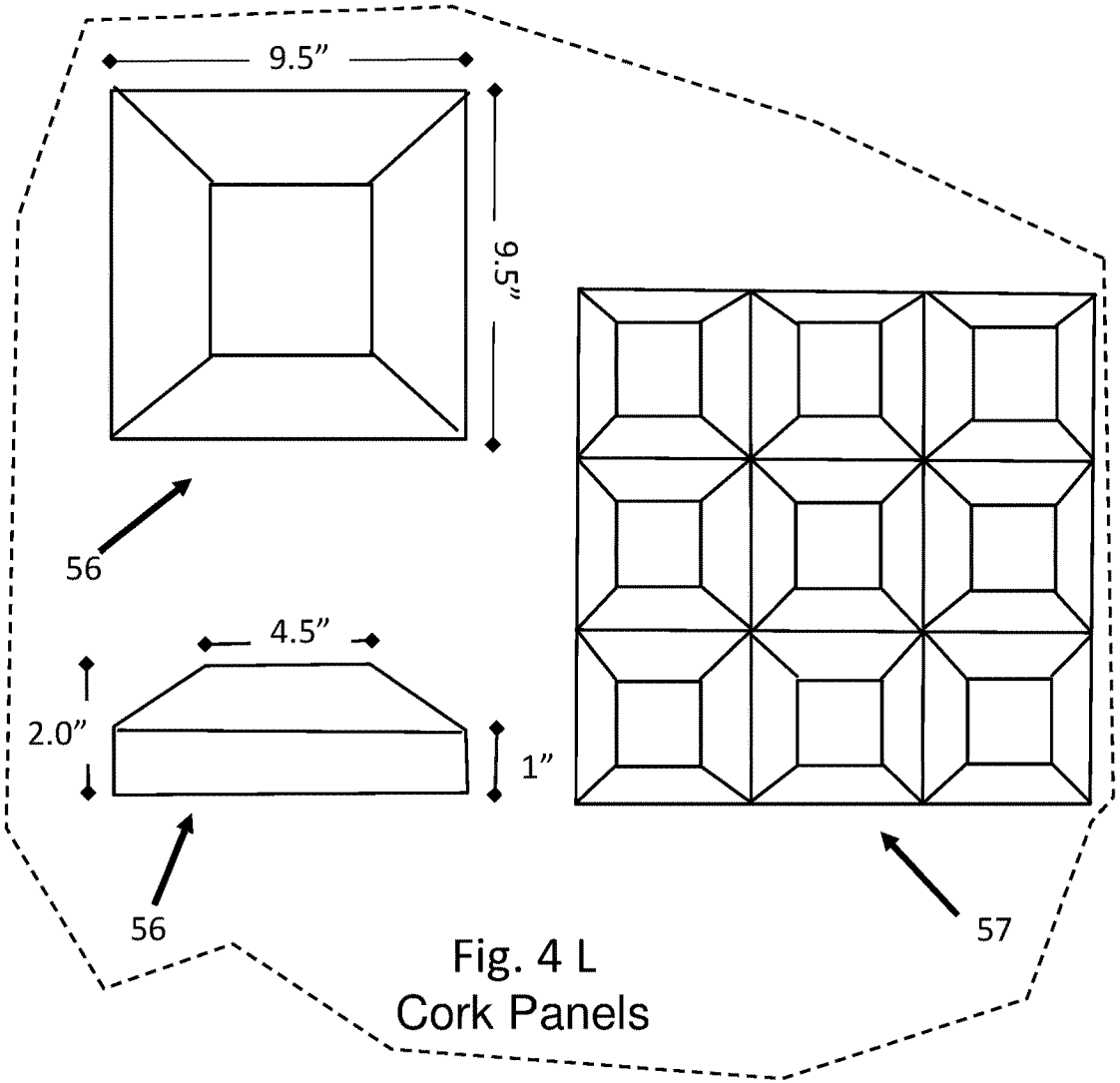
Figure 4K:
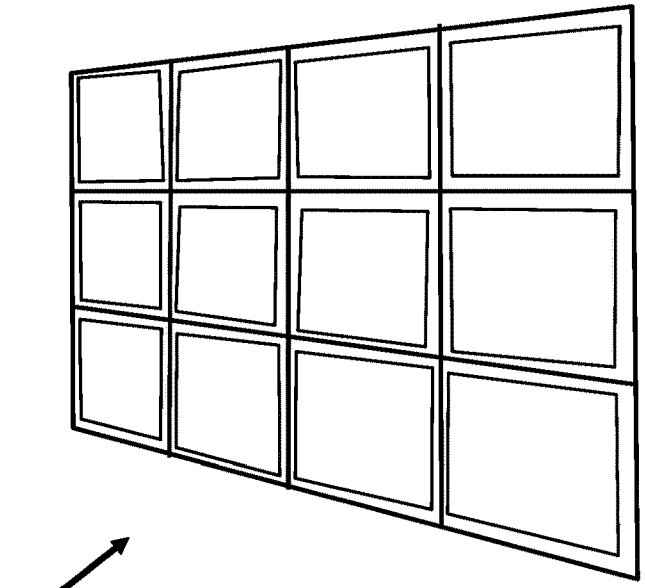
Figure 5A:
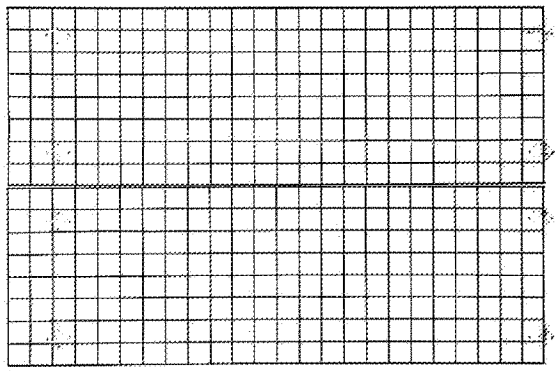
Figure 5B:
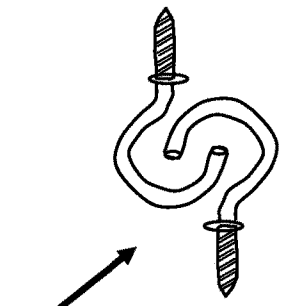
Figure 5C:
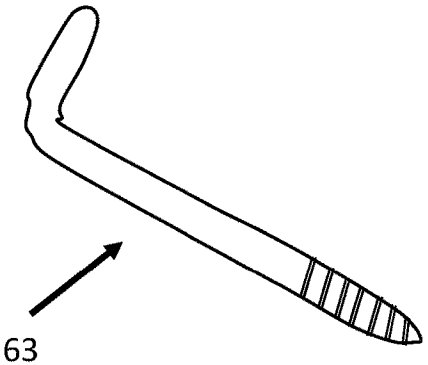
Figure 5D:
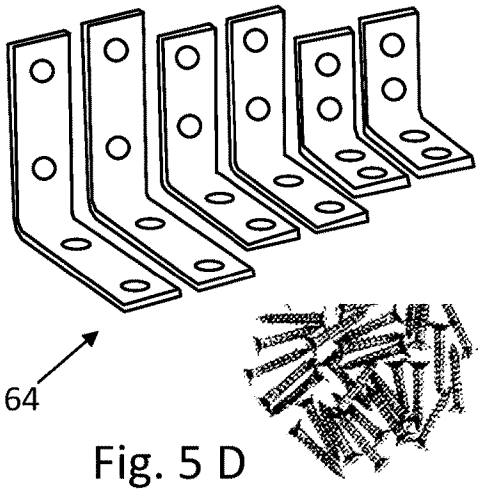
Figure 5E:
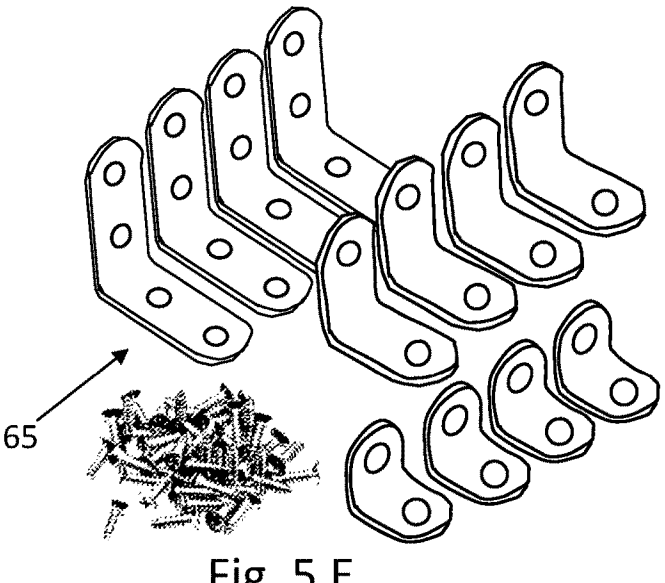
Figure 5F:
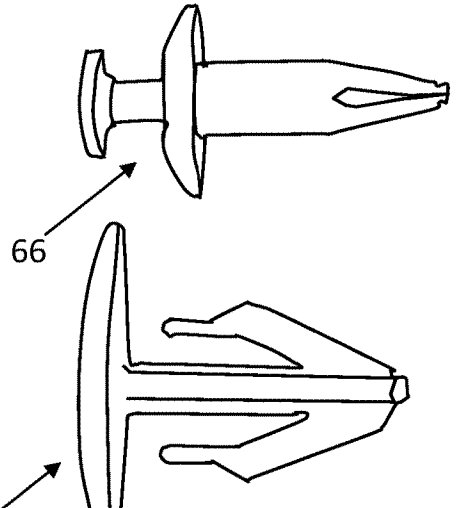
Figure 5G:
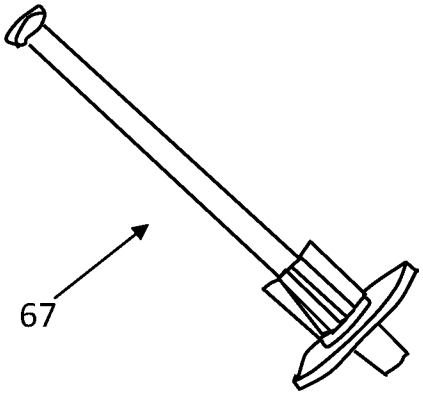
Figure 5H:
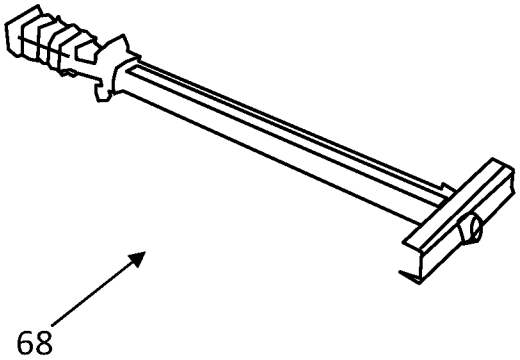
Figure 5I:
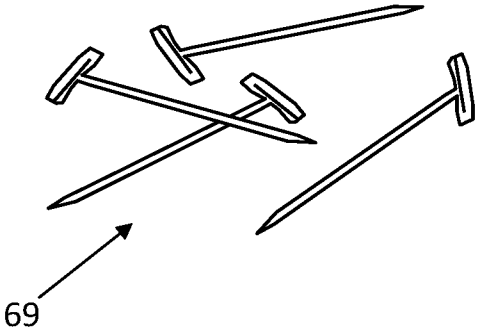
Figure 5J:
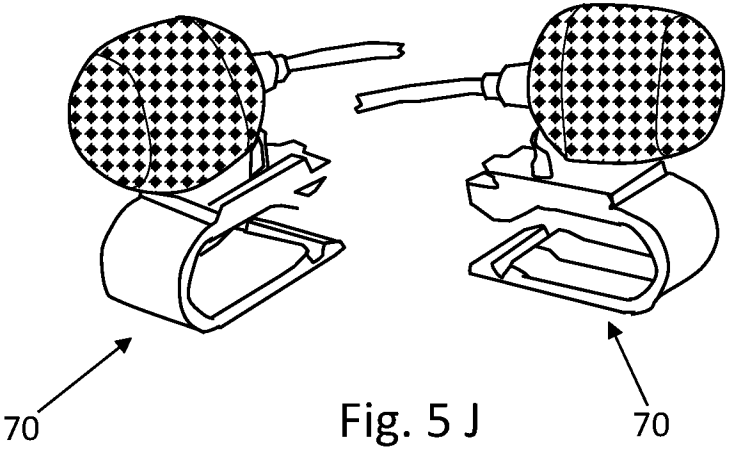
Figure 5K:
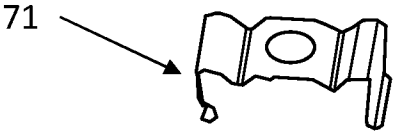
Figure 5N:
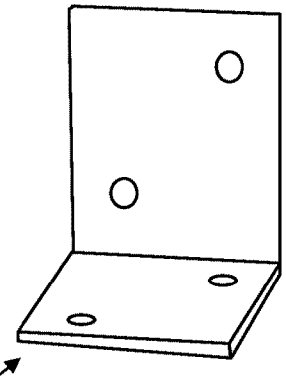
Figure 5M:
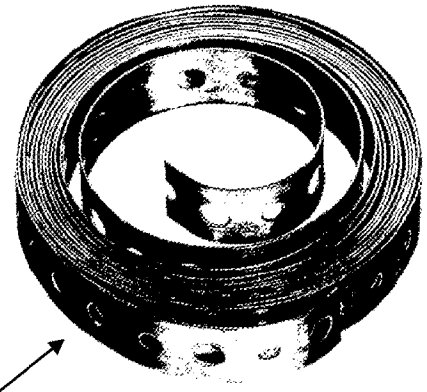
Figure 5L:
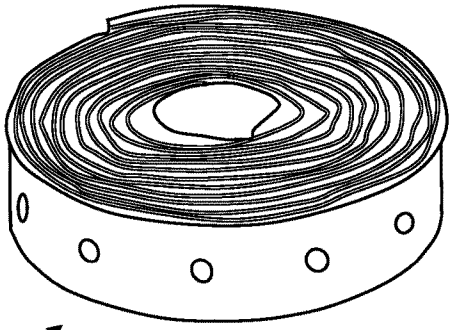
Figure 5P:
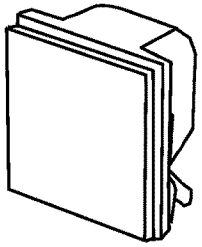
Figure 5P:
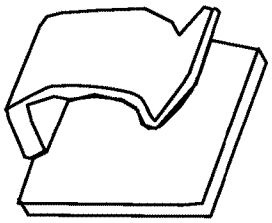
Figure 5O:
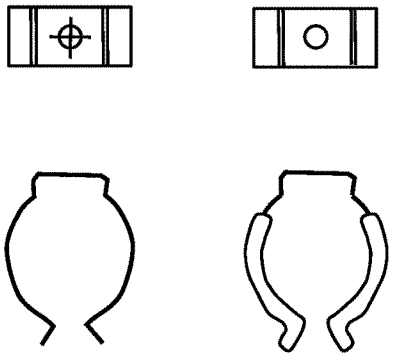
Figure 6A:
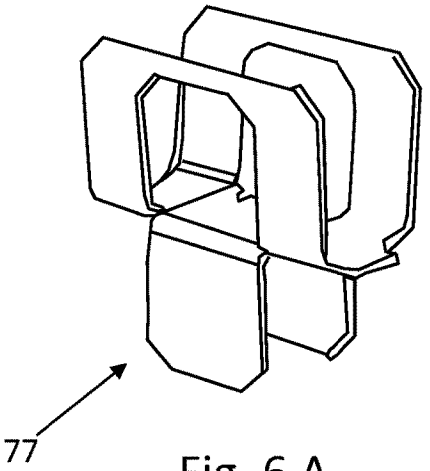
Figure 6B:
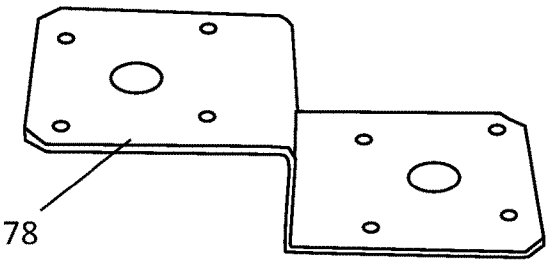
Figure 6C:
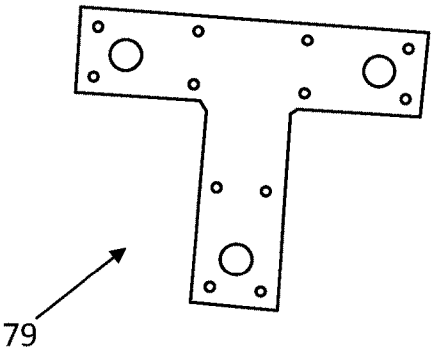
Figure 6D:
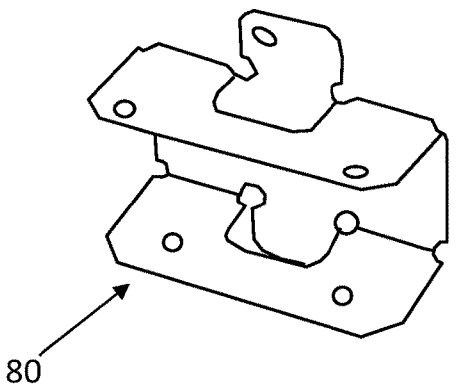
Figure 6E:
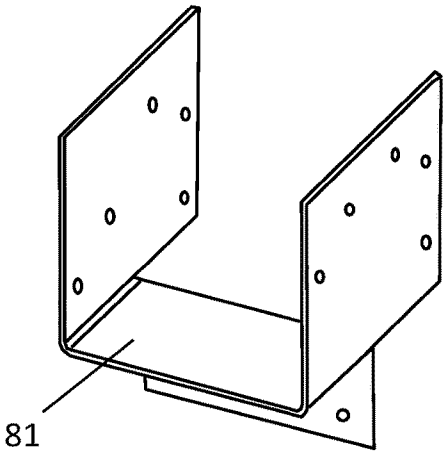
Figure 6F:
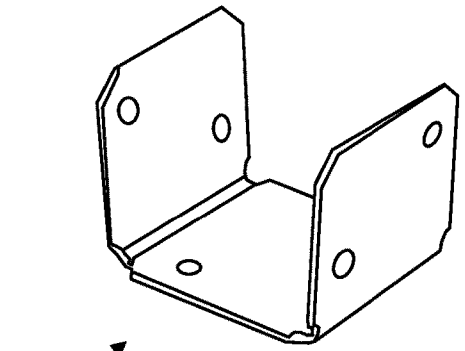
Figure 6G:
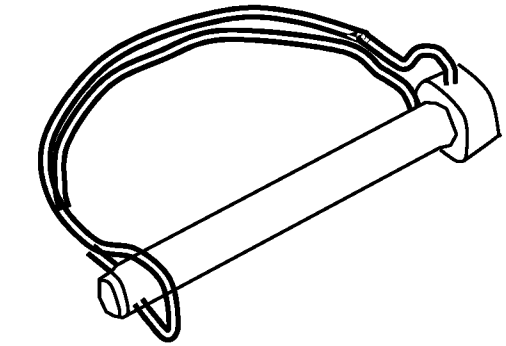
Figure 6H:
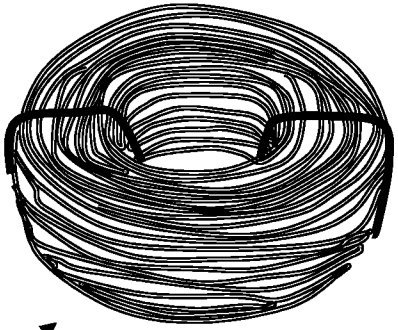
Figure 6I:
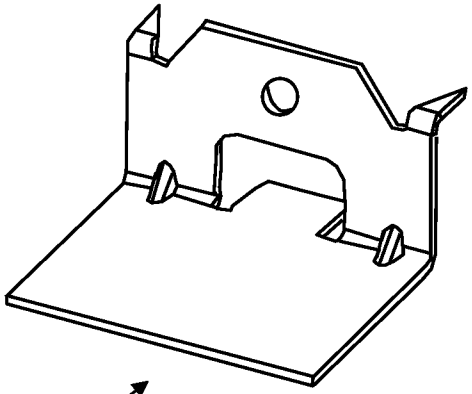
Figure 6J:
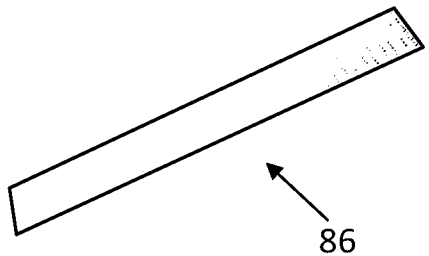
Figure 6K:
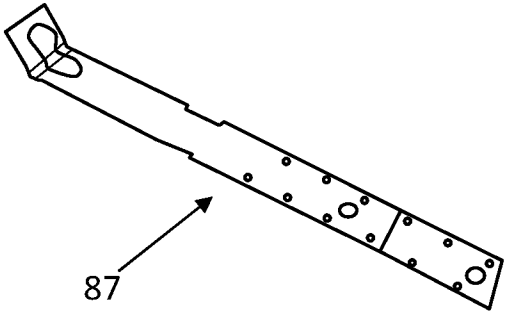
Figure 6L:
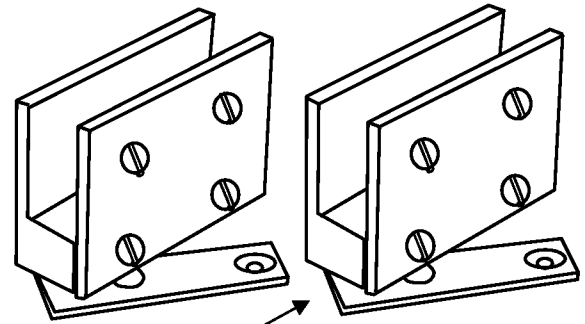
Figure 6O:
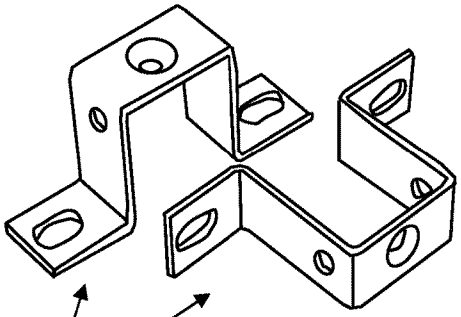
Figure 6N:
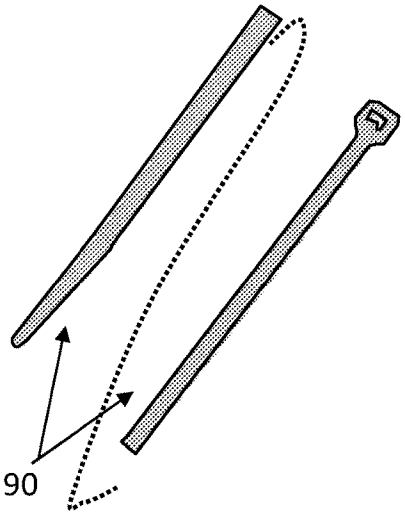
Figure 6M:
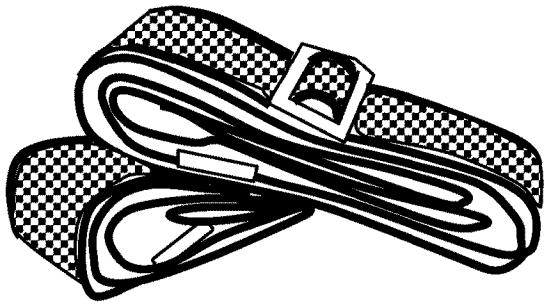
Figure 6R:
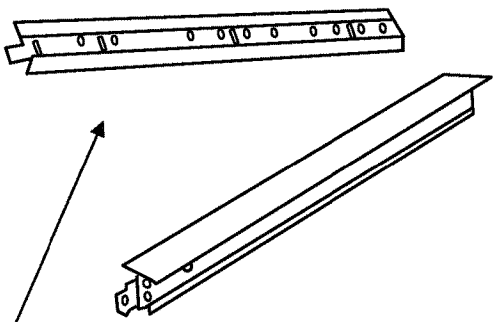
Figure 6Q:
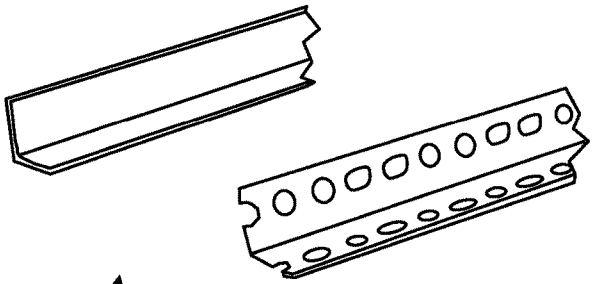
Figure 6P:
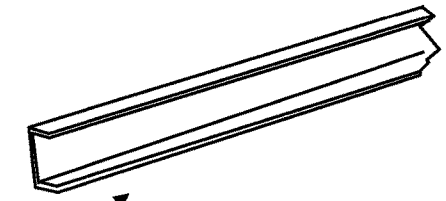
Figure 6T:
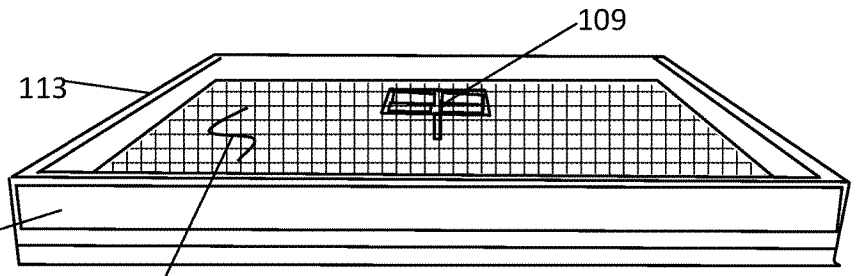
Figure 6S:
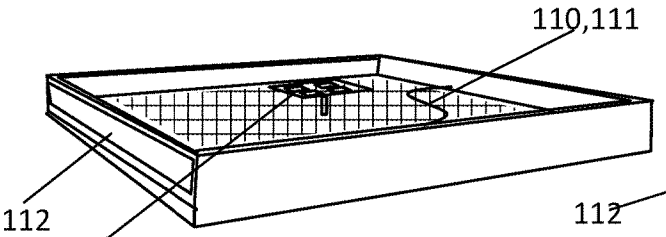
Figure 6U:
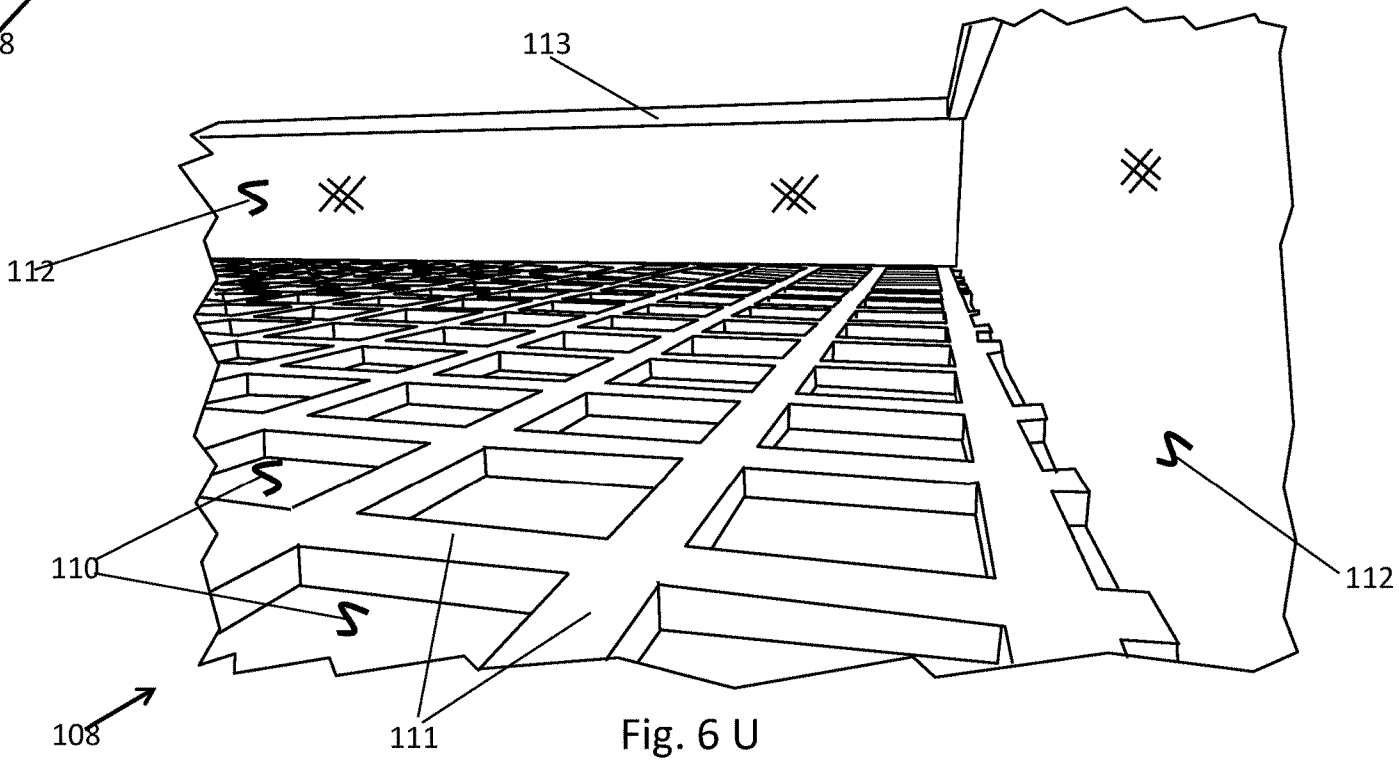

FIGS. 3 A through 3 D are sketches of the Special lightweight, durable mounting system for sound foam panel with the components and features shown from generally a top and a side view.

FIGS. 4 A through 4 L are sketches of various types of acoustic panels for a Special lightweight, durable mounting system for sound foam panels.

FIGS. 5 A through 5 P are sketches of various means for securing acoustic panels to a frame of the Special lightweight, durable mounting system for sound foam panels.

FIGS. 6 A through 6 O are sketches of various other types of fasteners and means for securing acoustic panels to a frame of the Special lightweight, durable mounting system for sound foam panels. FIGS. 6 P through 6 U lightweight, durable framing components and systems for sound foam panels.

Figures 7A, 7B, 7C:
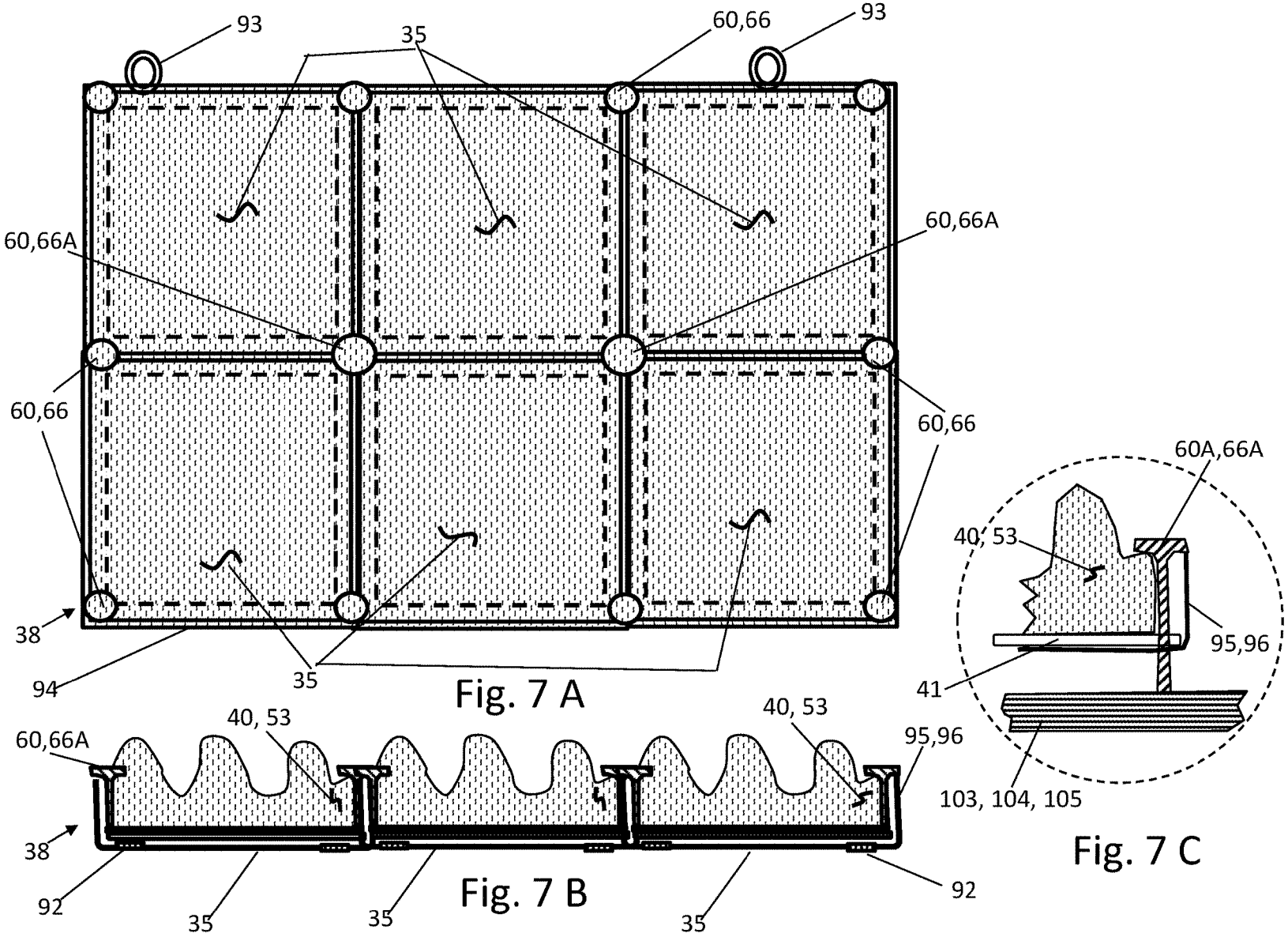
Figure 9D:
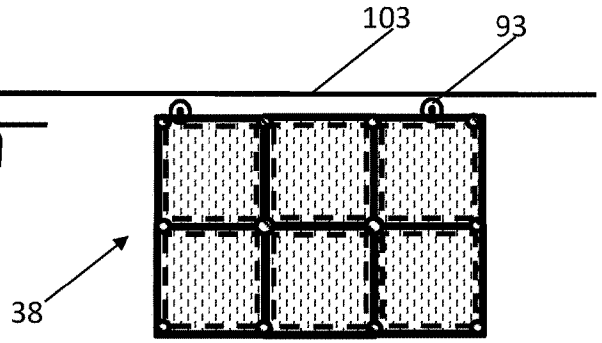
Figure 9B:
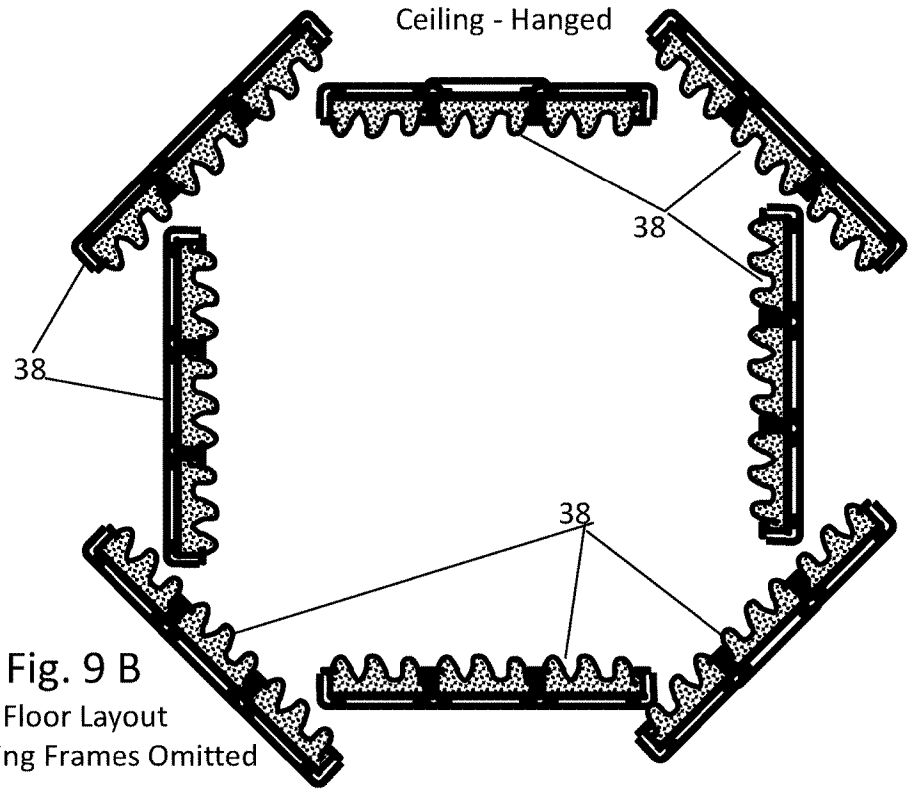
Figure 9C:
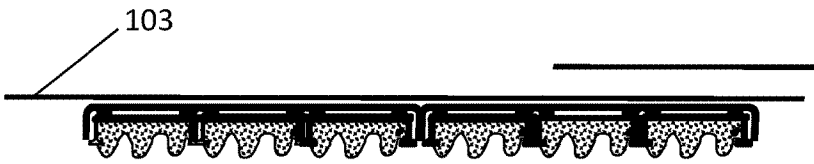
Figure 9A:
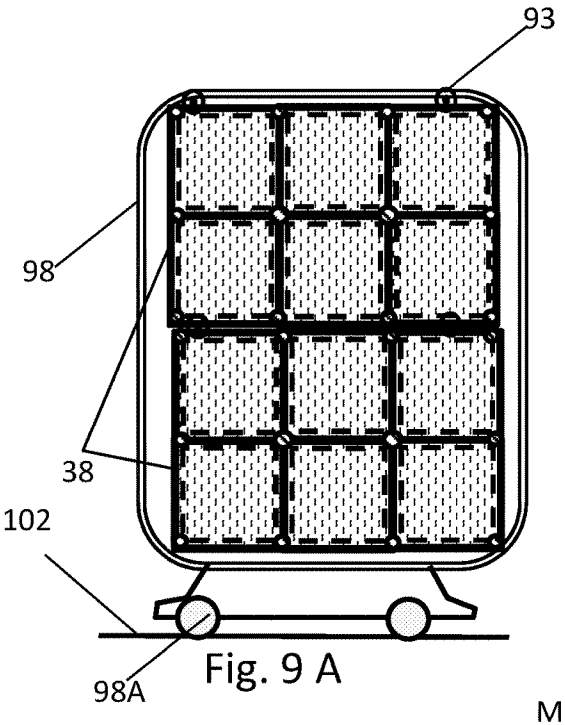
Figure 10C:
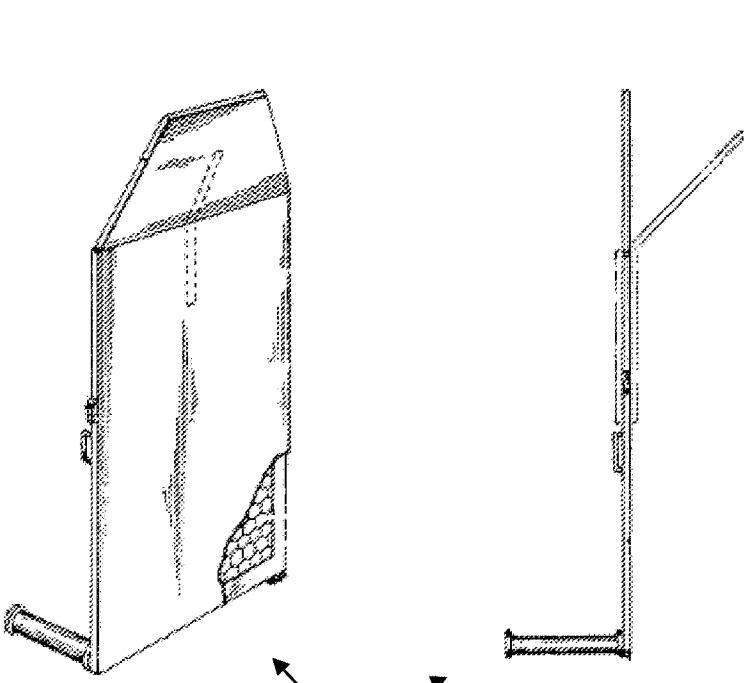
Figure 10B:
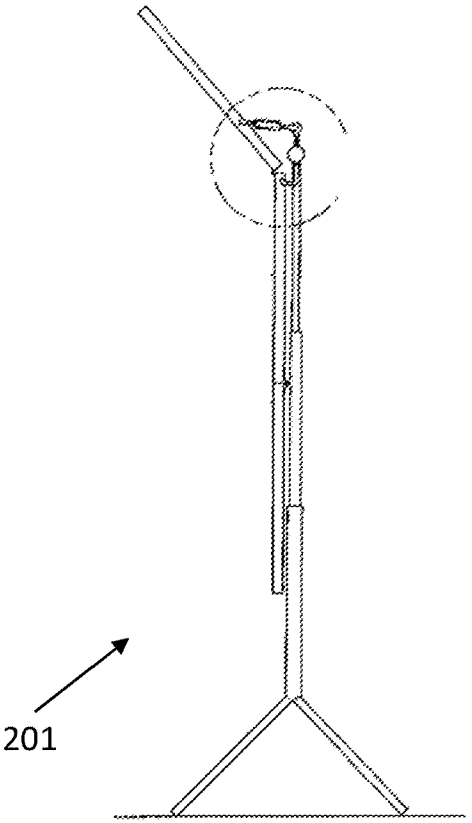
Figure 10A:
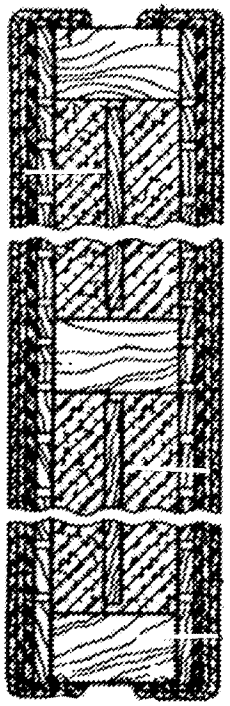
Figure 10E:
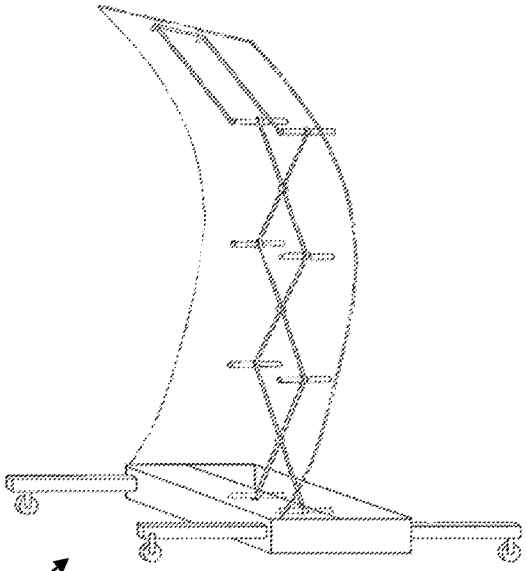
Figure 10F:
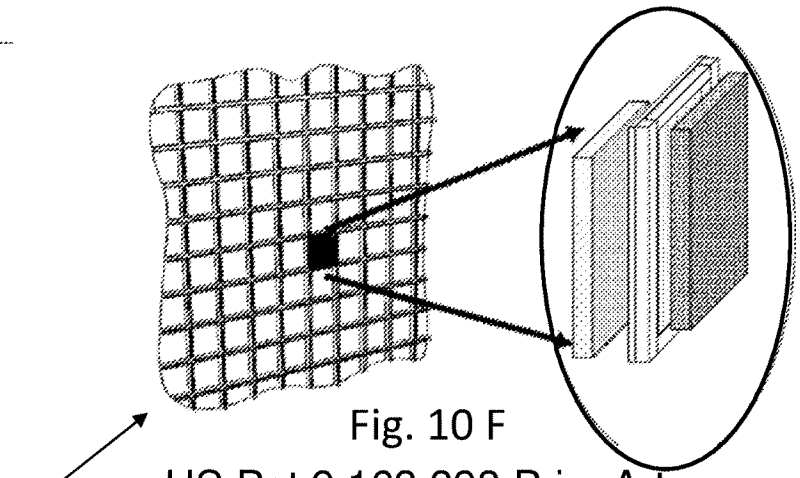
Figure 10D:
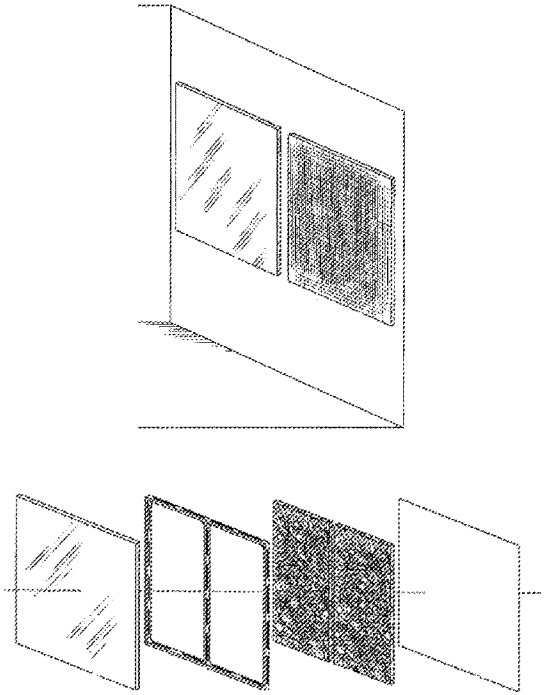

FIGS. 7 A through 7 C are sketches of combining several acoustic panels into an assembly for mounting.

FIGS. 8 A and 8 B are sketches of mounting the acoustic panel assemblies in a small room to provide a portable and fast set-up recording or sound analysis room.

FIGS. 9 A through 9 D are sketches of mounting the acoustic panel assemblies in a larger setting to provide a portable and fast set-up recording or sound analysis room.

FIGS. 10 A through 10 F are sketches of prior art of older and cumbersome acoustical panels and assemblies.

DESCRIPTION OF THE DRAWINGS—REFERENCE TO ELEMENTS

The following list refers to the drawings:

TABLE B

| Reference numbers | |
|---|---|
| Ref # | Description |
| 30 | Special lightweight, durable mounting system for sound foam panels 30 |
| 33 | prototype 33 of a special lightweight, durable mounting system for sound foam panels 30 |
| 35 | special lightweight, durable sound foam panel 35 mounted with an L frame 96 |
| 36 | special lightweight, durable sound foam panel 36 mounted with a C frame 97 |
| 38 | assembly 38 of special lightweight, durable sound foam panel 36, 35 with an L frame 96 or with a C frame 97 |
| 40 | acoustic panels 40 |

TABLE B-continued

| Reference numbers | |
|---|---|
| Ref # | Description |
| 41 | firm backing 41 to the acoustic panels 40, backing can be pressed cardboard, metal (steel, aluminum), plastic, composite material, or the like and may be a solid sheet or perforated sheet) |
| 42 | adhesive backing 42 to the firm backing 41 |
| 46 | wedge foam acoustic panels 46 |
| 47 | mainstays foam mattress pad - one half, three quarter or one inch thick or the like 47 |
| 48 | pyramid foam acoustic pads/panels 48 |
| 49 | sound proof rug pads 49 |
| 49A | fabric or vinyl cover 49A with and without perforations |
| 49B | adhesive, glue or the like |
| 50 | acoustic foam XL bass trap studio soundproofing pads for corner wall 50 |
| 51 | studio monitor speaker pads 51 |
| 52 | super-dense soundproofing pads 52 |
| 53 | eggshell foam pads/panels 53 |
| 54 | high dollar sound pads/panels 54 |
| 55 | multicolor foam pads/panels 55 |
| 56 | foam pads/panels with bevel 56 |
| 57 | cork pads/panels 57 |
| 58 | cross channels 58 for containment structure 94 which may be metal, aluminum, plastic, reinforces plastic or a stiff composite material |
| 59 | L or ell frames 59 for containment structure 94 which may be metal, aluminum, plastic, reinforces plastic or a stiff composite material |
| 60 | means 60 for securing acoustic panels 40 to frame 95 |
| 60A | means 60A for securing acoustic panels 40 to frame 95 whereas the means 60A protrudes and provides an air pocket or layer 110 between a ceiling 103 or wall surface 104, 105 and the back surface of the panel assembly 38 |
| 61 | grid Panels 60 |
| 62 | hooks 62 |
| 63 | L shape screws 63 |
| 64 | L clips 64 |
| 65 | right angle brackets 65 |
| 66 | rivets and car rivets 66 |
| 66A | large headed rivets and car rivets 66A |
| 67 | pin washers 67 |
| 68 | toggle bolts 68 |
| 69 | t-pins 69 |
| 70 | mic clips 70 |
| 71 | T or tee bars 59 for cross structures of the containment structure 94 which may be metal, aluminum, plastic, reinforces plastic or a stiff composite material |
| 72 | plastic hanger strap 72 |
| 73 | metal hanger straps 73 |
| 74 | framing angles 74 |
| 75 | light bulb clips 75 |
| 76 | wire cable clips 76 |
| 77 | plywood clips 77 |
| 78 | decking ties 78 |
| 79 | tee straps 79 |
| 80 | double Clips 80 |
| 81 | header hangers 81 |
| 82 | U clips 82 |
| 83 | lock pins 83 |
| 84 | Wire of any sorts 84 |
| 85 | drywall clips 85 |
| 86 | wall ties 86 |
| 87 | purlin anchors 87 |
| 88 | shower and glass clips 88 |
| 89 | nylon straps 89 |
| 90 | zip ties 90 |
| 91 | square brackets 91 |
| 92 | double sided mounting tape 92 or equal |
| 93 | mounting rings, hooks, loops or equal |
| 94 | containment structure 94 |
| 95 | edge frame 95 of containment structure 94 around acoustic pads 40 |

TABLE B-continued

| Reference numbers | |
|---|---|
| Ref # | Description |
| 96 | ell or L-shaped 96 edge frame 95 of containment structure 94 |
| 97 | channel shaped 97 edge frame 95 of containment structure 94 |
| 98 | vertical and tubular mounting frame 98 with wheel assembly 98A |
| 98A | wheel assembly 98A |
| 99 | inside contiguous point 99 acoustic panel 40 |
| 100 | tee shaped 100 inner frame of containment structure 94 |
| 101 | operator 101 |
| 102 | floor 102 |
| 103 | ceiling 103 |
| 104 | front wall 104 |
| 105 | sidewall 105 |
| 108 | enclosure tray 108 to hold the acoustic panels 40 |
| 109 | tee plate 109 that contains the acoustic panels 40 and that is secured to the floor ribs 111 of the tray 108 |
| 110 | air pocket or layer 110 |
| 111 | floor ribs 111 of the enclosure tray 108 |
| 112 | side walls/end walls 112 of the enclosure tray 108 |
| 113 | top ribs 113 of sidewalls 112 that contain acoustic panels 40 at the top perimeter of the tray 108 |
| 200 | prior Art 200 U.S. Pat. No. 5,009,043 |
| 201 | prior Art 201 U.S. Pat. No. 8,091,605 and U.S. patent application Ser. No. 2012/0152468 |
| 202 | prior Art 202 U.S. Pat. No. 5,069,011 |
| 203 | prior Art 203 U.S. patent application Ser. No. 2008/0029336 |
| 204 | prior Art 204 U.S. Pat. No. 9,378,726 |
| 205 | prior Art 205 U.S. Pat. No. 9,163,398 |

Detailed Description of Preferred Embodiment

This invention relates to a Special lightweight, durable mounting system for sound foam panel and quick installation process. The present invention relates generally to mounting acoustic panels. More particularly, the present invention relates to the mounting of an acoustic panel having an easy to install and a portable capability. This invention also relates to components and more particularly to temporary components adapted to attenuate the transmission of noise. This invention and application relate to the field of acoustic panels. This application relates to systems, structures, materials and designs used as a mounting system for sound and noise barriers. This relates to mounting for portable acoustical panels used in small or large performances to reflect and enhance the sound produced during rehearsals or recordings and such. The devices usually are assembled by placing a plurality of panels in adjacent relationship so as to form a screen or shell which is then mounted to a flat surface or hanged from a building structure or portable structure. The panels are ordinarily portable as stated, and then able to be packaged for storage or to selectively vary the shell configuration when the panels are disposed in operative position. Each panel usually has a framework which may be disposed vertically, horizontally, or at a selected angle to the vertical, often facing forwardly toward the audience or performer, to focus the acoustical reflection in the desired direction.

The advantages for the Special lightweight, durable mounting system for sound foam panel and quick installation process are listed above in the introduction. Succinctly the benefits are that the device:

1. Is lightweight;
2. Is durable;
3. Is unlike anything on the market today;
4. Can hold up to 32 1'×1' foam sound panels;
5. Has no assembly required;
6. Is offered in different sizes and depths;
7. Has multiple bracket options for cosmetic reasons;
8. Is fashionable and cool to look at and has good aesthetics;
9. Mounts with less and even no holes in the wall compared to what is current industry foam and acoustical standard;
10. Is portable and easy to put up in less than 5 minutes;
11. Can connect to other mounts for different room layouts;
12. Can use single panel holders for portable mic set ups—better and cheaper than current solutions;
13. Can be used anywhere and in any situation;
14. Has potential to make improvements and create other applications for it;
15. Is inexpensive to manufacture and buy;
16. Is a perfect solution for start-up studios and musicians;
17. Has fewer parts than anything in its category;
18. Is easier to make than anything in its category; and
19. Is not age specific, can be used in children's rooms, doctors' offices, studios, houses, rental properties, apartments, dorms, busses, cars.

This invention is a Special lightweight, durable mounting system for sound foam panel and quick installation process. It solves the basic question: "How can a musician, home owner, renter, tenant, or anyone looking to make a room quieter hang foam panels fast, cheap, and without harmful effects to the walls or foam panels?" The preferred embodiment of a special mounting device for a lightweight, durable sound foam panel and system with a quick installation process, the device is comprised of: (a) an acoustical pad 40 with selected sound absorption capabilities with and optional firm backing 41 attached to the pad 40; (b) an optional firm lay-in sheet 41 with or without adhesive 42; (c) a containment frame or structure 94; (d) a fastening means 60 for removably securing the acoustical pad to the frame; and (e) an installation means such as rings 93 for hanging or adhesive pads 92 for fastening to surfaces such as walls 104 or ceilings 103 wherein the sound foam panel device 30 and system provides a lightweight and portable acoustical panel structure 36,37 which is easily installed and used for sound attenuation and recording studios.

There is shown in FIGS. 1-10 a complete description and operative embodiment of the Special lightweight, durable mounting system for sound foam panel and quick installation process. In the drawings and illustrations, one notes well that the Figures and drawings demonstrate the general configuration and use of this product.

The drawings together with the summary description given above and a detailed description given below serve to explain the principles of the portable acoustic panel device 30. It is understood, however, that the device 30 is not limited to only the precise arrangements and instrumentalities shown. Other examples of acoustic sound devices and systems as well as their uses are still understood by one skilled in the art of acoustic and sound absorption devices and systems to be within the scope and spirit shown here.

FIGS. 1 A through 1 E are sketches of the special mounting system for a lightweight, durable sound foam panel, components and installation. Shown here are: a special lightweight, durable sound foam panel 30; a prototype 33 special lightweight, durable sound foam panel 30; an assembly 38 of special lightweight, durable sound foam panel 36, 35 with an L frame 96 or with a C frame 97; an acoustic panels 40; and a means 60 for securing acoustic panels 40 to frame 95.

FIG. 2 is a prototype of the special mounting system for a lightweight, durable sound foam panel with components and features noted. Provided in these sketches are: an assembly 38 of special lightweight, durable sound foam panel 36, 35 with an L frame 96 or with a C frame 97; an acoustic panels 40; one or more means for mounting 93 such as rings, hooks, loops or equal; a containment structure 94; an edge frame 95 of containment structure 94 around acoustic pads 40; an ell or L-shaped 96 edge frame 95 of containment structure 94; and an inside contiguous point 99 acoustic panel 40.

FIGS. 3 A through 3 D are sketches of the special mounting system 30 for a lightweight, durable sound foam panel with the components and features shown from generally a top and a side view. Demonstrated by these drawings are the components and features as follows: a special lightweight, durable sound foam panel 35 with an L frame 96; a special lightweight, durable sound foam panel 36 with a C frame 97; an acoustic panels 40; a firm backing 41 to the acoustic panels 40, backing can be pressed cardboard, metal (steel, aluminum), plastic, composite material, or the like and may be a solid sheet or perforated sheet); an adhesive backing 42 to the firm backing 41; a wedge foam acoustic panels 46; an eggshell foam panels 53; an eggshell foam panels 53; a means 60 for securing acoustic panels 40 to frame 95; a rivet and/or car rivet 66—made of plastic, metal or composite material; a double sided mounting tape 92 or equal; one or more means for mounting 93 such as rings, hooks, loops or equal; an edge frame 95 of containment structure 94 around acoustic pads 40; an ell or L-shaped 96 edge frame 95 of containment structure 94; a channel shaped 97 edge frame 95 of containment structure 94; vertical and tubular mounting frame 98 with wheel assembly 98A; and a wheel assembly 98A or support frame with wheels.

FIGS. 4 A through 4 L are sketches of various types of acoustic panels 40 for the special lightweight, durable sound foam panel which absorb sound as described in the technical background as shown above. Portrayed here are the following panel sound absorption materials and acoustic pads 40 as examples and not limitations are: a wedge foam acoustic panels 46; a mainstay foam mattress pad—one half, three quarter or one inch thick or the like 47; a pyramid foam acoustic panels 48; a sound proof rug pads 49; a fabric or vinyl cover 49A with and without perforations; an acoustic foam XL bass trap studio soundproofing corner wall 50; a studio monitor speaker pads 51; a super-dense soundproofing 52; an eggshell foam panels 53; a high dollar sound panels 54; a multicolor foam panels 55; a foam panels with bevel 56; and a cork panel 57. In summary these acoustical pads and panels with selected sound absorption capability are selected from a group consisting of pyramid foam acoustic pads, sound proof rug pads, acoustic foam XL bass trap studio soundproofing pads, studio monitor speaker pads, super dense soundproofing pads, eggshell foam pads, high dollar sound pads, multicolor foam pads, foam pads/panels with bevel, and cork pads.

FIGS. 5 A through 5 P are sketches of various means for securing 60 acoustic panels 40 to a containment frame 94 of the special lightweight, durable sound foam panel. The frames include or are selected from cross channels, L or ell frames, channel shaped edge frames, vertical and tubular structures, and mounting tee shaped inner frames. Presented and demonstrated here for example and not as a limitation are: a means 60 for securing acoustic panels 40 to frame 95; a single grid panel 61; a single or group of multiple hooks 62; an L shape screw 63; an L clip 64; a right angle brackets 65; a rivet and/or car rivet 66—made of plastic, metal or composite material; a large headed rivets and car rivets 66A; a single or group of pin washers 67; a toggle bolt 68; a set of t-pins 69; one or more mic clips 70; a T or tee bars 59 for center cross structures of the containment structure 94 which may be metal, aluminum, plastic, reinforces plastic or a stiff composite material; a plastic hanger strap 72; a metal hanger strap 73; a framing angle 74; a set of light bulb clips 75; and a set of wire cable clips 76. Importantly, clips can protrude out the rear of a wall or ceiling mount. When doing so, this creates an air pocket/layer between the panel and the wall or ceiling surface. This air pocket can provide additional dampening of the overall sound to provide even more attenuation of the background sound/noise.

FIGS. 6 A through 6 O are sketches of various other types of fasteners and means for securing acoustic panels to a frame of the special lightweight, durable sound foam panel. Further examples of a means 60 for securing acoustic panels 40 to frame 95 shown in these sketches are: a group of plywood clips 77; a series of decking ties 78; a tee strap 79; a set of double clips 80; a header hanger 81; a set of U clips 82; a group of lock pins 83; a wire of any sorts 84; a drywall clip 85; a group of wall ties 86; one or more purlin anchors 87; a series of shower and glass clips 88; a nylon strap 89; a group of zip ties 90; and a set of square brackets 91. Also, note that FIGS. 6 P through 6 U lightweight, durable framing components and systems for sound foam panels. Here is provided an L frame 96 or with a C frame 97 as viewed and shown as a cross channels 58 for containment structure 94 which may be metal, aluminum, plastic, reinforces plastic or a stiff composite material; an L or ell frames 59 for containment structure 94 which may be metal, aluminum, plastic, reinforces plastic or a stiff composite material; and a T or tee bars 59 for center cross structures of the containment structure 94 which may be metal, aluminum, plastic, reinforces plastic or a stiff composite material. In FIGS. 6 S through 6 U the lightweight, durable framing systems for sound foam panels show a tray 108 that encloses the acoustic pads 40 (not shown). Portrayed here are the enclosure tray 108 to hold the acoustic panels 40, a tee plate 109 that contains the acoustic panels 40 and that is secured to the floor ribs 111 of the tray 108, the air pockets or layers of air 110 between the ribs 111, the floor ribs 111 of the enclosure tray 108, the side walls/end walls 112 of the enclosure tray 108, and the top ribs 113 of sidewalls 112 that contain acoustic panels 40 at the top perimeter of the tray 108.

FIGS. 7 A through 7 C are sketches of combining several acoustic panels 35, 36 into an assembly 38 for mounting. Portrayed here are the components in an assembly 38: a special lightweight, durable sound foam panel 35 with an L frame 96; an assembly 38 of special lightweight, durable sound foam panel 36, 35 with an L frame 96 or with a C frame 97; an acoustic panels 40; a means 60 for securing acoustic panels 40 to frame 95; a rivet and/or car rivet 66—made of plastic, metal or composite material; a large headed rivets and car rivets 66A; a double sided mounting tape 92 or equal; one or more means for mounting 93 such as rings, hooks, loops or equal; a containment structure or frame 94; an edge frame 95 of containment structure 94 around acoustic pads 40; and an ell or L-shaped 96 edge frame 95 of containment structure 94. FIG. 7 C shows a means 60A for securing acoustic panels 40 to frame 95 whereas the means 60A protrudes and provides an air pocket or layer 110 between a ceiling 103 and/or wall surface 104,105 and the back surface of the panel assembly 38.

FIGS. 8 A and 8 B are sketches of mounting the acoustic panel assemblies in a small room to provide a portable and fast set-up recording or sound analysis room. FIGS. 9 A through 9 D are sketches of mounting the acoustic panel assemblies in a larger setting to provide a portable and fast set-up recording or sound analysis room. These are discussed below in the operation section.

FIGS. 10 A through 10 F are sketches of prior art of older and cumbersome acoustical panels and assemblies. Here former patents and applications are shown for various acoustic panels and sound absorption systems. These include: a prior Art 200 U.S. Pat. No. 5,009,043; a prior Art 201 U.S. Pat. No. 8,091,605 and US Patent Application 2012/0152468; a prior Art 202 U.S. Pat. No. 5,069,011; a prior Art 203 US Patent Application 2008/0029336; a prior Art 204 U.S. Pat. No. 9,378,726; and a prior Art 205 U.S. Pat. No. 9,163,398. As can be seen, compared to these prior art, the Special lightweight, durable sound foam panel device and system 30 with a quick installation process is a unique combination and use of a portable and lightweight acoustic panel device and system as described herein.

The details mentioned here are exemplary and not limiting. Other specific components and manners specific to describing a special lightweight, durable sound foam panel device and system 30 with a quick installation process may be added as a person having ordinary skill in the field of the art of sound and acoustic panels and their uses may well appreciate.

Operation of the Preferred Embodiment

The Special lightweight, durable mounting system for sound foam panel 30 and quick installation process has been described in the above embodiment. The manner of how the device operates is described below. One notes well that the description above and the operation described here must be taken together to fully illustrate the concept of the portable acoustical panel structure 30. The preferred embodiment of the invention is a Special lightweight, durable mounting system 30 for sound foam panel and quick installation process, the device is comprised of: (a) an acoustical pad 40 with selected sound absorption capabilities with and optional firm backing 41 attached to the pad 40; (b) an optional firm lay-in sheet 41 with or without adhesive 42; (c) a containment frame or structure 94; (d) a fastening means 60 for removably securing the acoustical pad to the frame; and (e) an installation means such as rings 93 for hanging or adhesive pads 92 for fastening to surfaces such as walls 104 or ceilings 103 wherein the sound foam panel device 30 and system provides a lightweight and portable acoustical panel structure 36,37 which is easily installed and used for sound attenuation and recording studios.

The Special lightweight, durable mounting system 30 for sound foam panel and quick installation process is operated by building a contained foam or acoustical pad 40 into a containment structure 94. These are normally approximately 9 to 18 inches square or rectangular shape. These individual contained pads 36, 37 are then contiguously placed together and held with faster means 60 to form a panel assembly 38. Next the assemblies 38 are placed on a wall 104 or ceiling 103 with an adhesive double sided tape 92. Another mount involves a standard fastening means 60 to a flat surface 103,104 or may be hanged with a ring means 93 to a ceiling 103 or tubular mounting frame 98, or equal.

FIGS. 8 A and 8 B are sketches of mounting the acoustic panel assemblies in a small room to provide a portable and fast set-up recording or sound analysis room. Provided in these sketches are the components in the installation for a small room, studio or office. Shown are: an assembly 38 of special lightweight, durable sound foam panel 36, 35 with an L frame 96 or with a C frame 97; one or more means for mounting 93 such as rings, hooks, loops or equal; a floor 102; a ceiling 103; a front wall 104; and a sidewall 105.

FIGS. 9 A through 9 D are sketches of mounting the acoustic panel assemblies in a larger setting to provide a portable and fast set-up recording or sound analysis room. This may be a large room, gymnasium, auditorium or even an outdoor venue. Shown are: an assembly 38 of special lightweight, durable sound foam panel 36, 35 with an L frame 96 or with a C frame 97; one or more means for mounting 93 such as rings, hooks, loops or equal; vertical and tubular mounting frame 98 with wheel assembly 98A; wheel assembly 98A and support frame with wheels; a floor 102; and a ceiling 103.

Many uses are anticipated for the Special lightweight, durable mounting system 30 for sound foam panel and quick installation process. Some examples, and not limitations, are shown in the following Table.

| ITEM | DESCRIPTION |
|---|---|
| 1 | Small room recording studio at home |
| 2 | Small room recording studio at office |
| 3 | Recording and sound analysis session in hotel |
| 4 | Portable sound walls for larger venues such as an auditorium or gymnasium |
| 5 | Recording and sound analysis session at a college laboratory |
| 6 | Audio testing at medical and lab facilities |
| 7 | Quiet area for restaurants |
| 8 | Quiet area for meeting venues like coffee shops, computer rooms and bars/taverns |

With this description it is to be understood that the Special lightweight, durable mounting system 30 for sound foam panel and quick installation process is not to be limited to only the disclosed embodiment of product. The features of the portable acoustic device 30 are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

The present invention contemplates modifications as would occur to those skilled in the art. While the disclosure has been illustrated and described in detail in the figures and the foregoing description, the same is to be considered as illustrative and not restrictive character, it being understood that only selected embodiments have been shown and described and that all changes, modifications and equivalents that come within the spirit of the disclosures described heretofore and or/defined by the following claims are desired to be protected.

What is claimed is:

1. A lightweight and portable sound attenuating panel structure comprised of:

(a) a lightweight, durable mounting system comprising an installation means that includes a plurality of adhesive pads for fastening a containment frame to a surface of a wall or a ceiling;

(b) the containment frame around a perimeter of a plurality of acoustical pads, the containment frame defining a sound attenuating panel;

(c) the plurality of acoustical pads of the sound attenuating panel whereby each acoustical pad comprises an acoustical pad with a selected sound absorption capability and with a perimeter around the acoustical pad and two surfaces; and (d) at least one T-shaped fastening means for removably securing each of the acoustical pads to the containment frame, whereby the at least one T-shaped fastening means is to be positioned at corners of each acoustical pad and overlap either the corners of adjacent acoustical pads or the corner of an acoustical pad and the containment frame of the sound attenuating panel structure in order to secure such acoustical pads within the frame;

wherein the lightweight and portable sound attenuating panel structure can be installed with tools, is used for sound attenuation and recording studios, and can be removed without damaging or leaving holes where removably mounted.

2. The lightweight and portable sound attenuating panel structure in claim 1 wherein each of the acoustical pads is further comprised with a firm backing attached to a surface of the acoustical pad which is the surface that is contiguous to the containment frame.

3. The lightweight and portable acoustical panel structure in claim 2 wherein the firm backing has a plurality of adhesive pads which secure the acoustic pad to the containment frame and which creates an air pocket between the firm backing and the surface of the wall or the ceiling.

4. The lightweight and portable sound attenuating panel structure in claim 2 wherein the containment frame comprises an enclosure tray to hold each of the acoustic pads, wherein the enclosure tray consists of side walls and end walls, each wall with a top rib that contains the acoustic pads consists of a series of floor ribs that surround the perimeter and creates an air pocket between the surface of the wall or the ceiling, and the at least one T-shaped fastening means consists of a tee plate that contains each of the acoustic panels at the center of the enclosure tray wherein a plurality of enclosure trays can be grouped together and secured at a sidewall of the enclosure trays.

5. The lightweight and portable sound attenuating panel structure in claim 4 wherein the firm backing comprises a firm lay-in sheet that is positioned between one surface of the plurality of acoustical pads and contiguously to a surface of the containment frame.

6. The lightweight and portable sound attenuating panel structure in claim 1 wherein each of the acoustical pads with selected sound absorption capability is selected from the group consisting of pyramid foam acoustic pads, sound proof rug pads, acoustic foam XL bass trap studio soundproofing pads, studio monitor speaker pads, eggshell foam pads, multicolor foam pads, foam pads with bevel, and cork pads.

7. The lightweight and portable sound attenuating panel structure in claim 1 wherein the containment frame is selected from the group consisting of cross channels, L frames, channel shaped edge frames, vertical and tubular structures, and mounting tee shaped inner frames.

8. The lightweight and portable sound attenuating panel structure in claim 1 wherein the T-shaped fastening means is selected from the group consisting of a rivet, a car rivet, a large headed rivet, a single or group of pin washers, a toggle bolt, a set of t-pins, and tee bars and screws.

9. A lightweight and portable sound attenuating panel structure comprised of:

(a) a containment frame around a perimeter of a plurality of acoustical pads the frame defining a sound attenuating panel;

(b) the plurality of acoustical pads of the sound attenuating panel whereby each acoustical pad comprises an acoustical pad with a selected sound absorption capability and with a perimeter around the acoustical pad and two surfaces;

(c) at least one T-shaped fastening means for removably securing each of the acoustical pads to the containment frame, whereby the at least one T-shaped fastening means is to be positioned at corners of each acoustical pad and overlap either the corners of adjacent acoustical pads or the corner of an acoustical pad and the containment frame of the sound attenuating panel structure in order to secure such acoustical pads within the frame; and (d) an installation means of a plurality of rings for hanging the sound attenuating panel structure from walls or ceilings wherein the sound attenuating panel structure provides a lightweight and portable system which is used for sound attenuation and recording studios, and can be removed without damage for reuse.

10. The lightweight and portable sound attenuating panel structure in claim 9 wherein each of the acoustical pads is further comprised with a firm backing attached to one surface of the acoustical pad.

11. The lightweight and portable acoustical panel structure in claim 9 wherein a firm lay-in sheet is positioned between one surface of the plurality of acoustical pads and contiguously to a surface of the containment frame.

12. The lightweight and portable sound attenuating panel structure in claim 9 wherein each of the acoustical pads with selected sound absorption capability is is selected from the group consisting of pyramid foam acoustic pads, sound proof rug pads, acoustic foam XL bass trap studio soundproofing pads, studio monitor speaker pads, eggshell foam pads, multicolor foam pads, foam pads with bevel, and cork pads.

13. The lightweight and portable sound attenuating panel structure in claim 9 wherein the frame is selected from the group consisting of cross channels, L frames, channel shaped edge frames, vertical and tubular structures, and mounting tee shaped inner frames.

14. The lightweight and portable sound attenuating panel structure in claim 9 wherein the T-shaped fastening means is selected from the group consisting of a rivet, a car rivet, a large headed rivet, a single or group of pin washers, a toggle bolt, a set of t-pins, and tee bars and screws.

15. A lightweight and portable acoustical sound attenuating panel structure comprised of:

(a) a containment frame around a perimeter of a plurality of acoustical pads the frame defining a sound attenuating panel;

(b) the plurality of acoustical pads of the sound attenuating panel whereby each acoustical pad comprises an acoustical pad with a selected sound absorption capability and with a perimeter around the pad and two surfaces;

(c) at least one T-shaped fastening means for removably securing each of the acoustical pads to the containment frame, whereby the at least one T-shaped fastening means is to be positioned at corners of each acoustical pad and overlap either the corners of adjacent acoustical pads or the corner of an acoustical pad and the containment frame of the sound attenuating panel structure in order to secure such acoustical pads within the frame; and (d) an installation means of a frame with a wheel assembly and a support frame with rollers for supporting from surfaces such as floors and horizontal surfaces wherein the sound attenuating panel structure provides a lightweight and portable system which is used for sound attenuation and recording studios, and can be removed without damage for reuse.

16. The lightweight and portable sound attenuating panel structure in claim 15 wherein each of the acoustical pads is further comprised with a firm backing attached to one surface of the acoustical pad which is the surface that is contiguous to the containment frame.

17. The lightweight and portable acoustical panel structure in claim 16 wherein the firm backing has a plurality of adhesive pads which secure the acoustic pad to the containment frame and which creates an air pocket between the firm backing and the surface of the wall or the ceiling.

18. The lightweight and portable sound attenuating panel structure in claim 15 wherein each of the acoustical pads with selected sound absorption capability is is selected from the group consisting of pyramid foam acoustic pads, sound proof rug pads, acoustic foam XL bass trap studio soundproofing pads, studio monitor speaker pads, eggshell foam pads, multicolor foam pads, foam pads with bevel, and cork pads.

19. The lightweight and portable sound attenuating panel structure in claim 15 wherein the frame is selected from the group consisting of cross channels, L frames, channel shaped edge frames, vertical and tubular structures, and mounting tee shaped inner frames.

20. The lightweight and portable sound attenuating panel structure claim 15 wherein the T-shaped fastening means is selected from the group consisting of a rivet, a car rivet, a large headed rivet, a single or group of pin washers, a toggle bolt, set of t-pins, and tee bars and screws.

* * * * *